US009149089B2

(12) United States Patent
Cotterman et al.

(10) Patent No.: US 9,149,089 B2
(45) Date of Patent: Oct. 6, 2015

(54) LACE GUIDE

(75) Inventors: Jesse D. Cotterman, Evergreen, CO (US); Sean T. Cavanagh, Golden, CO (US); Michael J. Nickel, Golden, CO (US); William F. O'Dell, Evergreen, CO (US)

(73) Assignee: Boa Technology, Inc., Denver, CO (US)

( * ) Notice: Subject to any disclaimer, the term of this patent is extended or adjusted under 35 U.S.C. 154(b) by 1014 days.

(21) Appl. No.: 13/174,527

(22) Filed: Jun. 30, 2011

(65) Prior Publication Data

US 2012/0000091 A1 Jan. 5, 2012

Related U.S. Application Data

(60) Provisional application No. 61/360,636, filed on Jul. 1, 2010.

(51) Int. Cl.

| | |
|---|---|
| ***A43C 11/00*** | (2006.01) |
| ***A43C 3/00*** | (2006.01) |
| ***A43C 7/00*** | (2006.01) |

(52) U.S. Cl.

CPC ... *A43C 3/00* (2013.01); *A43C 7/00* (2013.01); *A43C 11/008* (2013.01)

(58) Field of Classification Search

CPC ..... A43C 11/008; A43C 7/00; A43C 11/02; A43C 1/00; A43C 1/004; A43C 3/00; A43C 5/00; A43C 11/14; A43C 11/16; A43C 5/01; Y10T 24/37

USPC ..... 24/713.3–713.8

See application file for complete search history.

(56) References Cited

U.S. PATENT DOCUMENTS

| | | | | |
|---|---|---|---|---|
| 59,332 A | | 10/1866 | White et al. | |
| 80,834 A | | 8/1868 | Prussia | |
| 117,530 A | | 8/1871 | Foote | |
| 228,946 A | | 6/1880 | Schulz | |
| 230,759 A | | 8/1880 | Drummond | |
| 379,113 A | | 3/1888 | Hibberd | |
| 568,056 A | | 9/1896 | Vail, Jr. | |
| 586,770 A | * | 7/1897 | Kempshall | 24/713.8 |
| 746,563 A | | 12/1903 | McMahon | |

(Continued)

FOREIGN PATENT DOCUMENTS

| | | |
|---|---|---|
| AT | 127075 | 2/1932 |
| AT | 244804 | 1/1966 |

(Continued)

OTHER PUBLICATIONS

U.S. Appl. No. 14/228,075, filed Mar. 27, 2014.

(Continued)

*Primary Examiner* — Robert J Sandy
*Assistant Examiner* — David Upchurch
(74) *Attorney, Agent, or Firm* — Knobbe, Martens, Olson & Bear, LLP

(57) ABSTRACT

Lacing systems can be used for tightening a shoe or other article. Some embodiments include a lace guide that includes a lace channel that is disposed below a portion of the shoe such that the lace channel is hidden from view, and an exposed end piece that is positioned on the exterior of the article such that the end piece is visible during use. The end piece can be generally bell-shaped and can provide a curved sliding surface for a lace to slide on when being tightened or loosened.

36 Claims, 9 Drawing Sheets

(56) References Cited

U.S. PATENT DOCUMENTS

| | | | | | |
|---|---|---|---|---|---|
| 819,993 | A | | 5/1906 | Haws et al. | |
| 908,704 | A | | 1/1909 | Sprinkle | |
| 1,060,422 | A | | 4/1913 | Bowdish | |
| 1,062,511 | A | | 5/1913 | Short | |
| 1,083,775 | A | | 1/1914 | Thomas | |
| 1,090,438 | A | | 3/1914 | Worth et al. | |
| 1,170,472 | A | | 2/1916 | Barber | |
| 1,288,859 | A | | 12/1918 | Feller et al. | |
| 1,368,971 | A | * | 2/1921 | Ross | 24/714.5 |
| 1,393,188 | A | | 10/1921 | Whiteman | |
| 1,469,661 | A | | 2/1922 | Migita | |
| 1,412,486 | A | | 4/1922 | Paine | |
| 1,416,203 | A | | 5/1922 | Hobson | |
| 1,481,903 | A | | 4/1923 | Hart | |
| 1,466,673 | A | | 9/1923 | Solomon et al. | |
| 1,530,713 | A | | 2/1924 | Clark | |
| 1,502,919 | A | | 7/1924 | Seib | |
| 1,862,047 | A | | 6/1932 | Boulet et al. | |
| 1,995,243 | A | | 6/1934 | Clarke | |
| 2,088,851 | A | | 8/1937 | Gantenbein | |
| 2,101,060 | A | * | 12/1937 | Gookin | 24/713.7 |
| 2,109,751 | A | | 3/1938 | Matthias et al. | |
| 2,124,310 | A | | 9/1938 | Murr, Jr. | |
| 2,316,102 | A | | 4/1943 | Preston | |
| 2,539,026 | A | | 1/1951 | Mangold | |
| 2,611,940 | A | | 9/1952 | Cairns | |
| 2,673,381 | A | | 3/1954 | Dueker | |
| 2,907,086 | A | | 10/1959 | Ord | |
| 2,962,924 | A | * | 12/1960 | Bahlo | 87/27 |
| 2,991,523 | A | | 7/1961 | Del Conte | |
| 3,028,602 | A | | 4/1962 | Miller | |
| 3,035,319 | A | | 5/1962 | Wolff | |
| 3,112,545 | A | | 12/1963 | Williams | |
| 3,163,900 | A | | 1/1965 | Martin | |
| 3,169,325 | A | | 2/1965 | Fesl | |
| 3,197,155 | A | | 7/1965 | Chow | |
| 3,221,384 | A | | 12/1965 | Aufenacker | |
| 3,276,090 | A | | 10/1966 | Nigon | |
| 3,401,437 | A | | 9/1968 | Christpohersen | |
| 3,430,303 | A | | 3/1969 | Perrin et al. | |
| 3,491,465 | A | | 1/1970 | Martin | |
| 3,535,749 | A | * | 10/1970 | Steinberg | 24/715.2 |
| 3,545,106 | A | | 12/1970 | Martin | |
| 3,574,900 | A | * | 4/1971 | Emery | 24/130 |
| 3,618,232 | A | | 11/1971 | Shnuriwsky | |
| 3,668,791 | A | | 6/1972 | Salzman et al. | |
| 3,678,539 | A | | 7/1972 | Graup | |
| 3,703,775 | A | | 11/1972 | Gatti | |
| 3,729,779 | A | | 5/1973 | Porth | |
| 3,738,027 | A | | 6/1973 | Schoch | |
| 3,793,749 | A | | 2/1974 | Gertsch et al. | |
| 3,808,644 | A | | 5/1974 | Schoch | |
| 3,812,811 | A | * | 5/1974 | Rodriguez | 114/218 |
| 3,934,346 | A | | 1/1976 | Sasaki et al. | |
| 3,975,838 | A | | 8/1976 | Martin | |
| 4,095,354 | A | | 6/1978 | Annovi | |
| 4,130,949 | A | | 12/1978 | Seidel | |
| 4,142,307 | A | | 3/1979 | Martin | |
| 4,227,322 | A | | 10/1980 | Annovi | |
| 4,261,081 | A | | 4/1981 | Lott | |
| 4,267,622 | A | | 5/1981 | Burnett-Johnston | |
| 4,361,938 | A | * | 12/1982 | Emery | 24/130 |
| 4,408,403 | A | | 10/1983 | Martin | |
| 4,433,456 | A | | 2/1984 | Baggio | |
| 4,433,679 | A | | 2/1984 | Mauldin et al. | |
| 4,463,761 | A | | 8/1984 | Pols et al. | |
| 4,480,395 | A | | 11/1984 | Schoch | |
| 4,507,878 | A | | 4/1985 | Semouha | |
| 4,551,932 | A | | 11/1985 | Schoch | |
| 4,555,830 | A | | 12/1985 | Petrini et al. | |
| 4,574,500 | A | | 3/1986 | Aldinio et al. | |
| 4,616,524 | A | | 10/1986 | Bidoia | |
| 4,619,057 | A | | 10/1986 | Sartor et al. | |
| 4,620,378 | A | | 11/1986 | Sartor | |
| 4,631,839 | A | | 12/1986 | Bonetti et al. | |
| 4,631,840 | A | | 12/1986 | Gamm | |
| 4,633,548 | A | * | 1/1987 | Siskind et al. | 24/715.1 |
| 4,633,599 | A | | 1/1987 | Morell et al. | |
| 4,654,985 | A | | 4/1987 | Chalmers | |
| 4,660,300 | A | | 4/1987 | Morell et al. | |
| 4,660,302 | A | | 4/1987 | Arieh et al. | |
| 4,680,878 | A | | 7/1987 | Pozzobon et al. | |
| 4,719,670 | A | | 1/1988 | Kurt | |
| 4,719,709 | A | | 1/1988 | Vaccari | |
| 4,719,710 | A | | 1/1988 | Pozzobon | |
| 4,722,477 | A | | 2/1988 | Floyd | |
| 4,741,115 | A | | 5/1988 | Pozzobon | |
| 4,748,726 | A | | 6/1988 | Schoch | |
| 4,760,653 | A | | 8/1988 | Baggio | |
| 4,780,969 | A | | 11/1988 | White, Jr. | |
| 4,787,124 | A | | 11/1988 | Pozzobon et al. | |
| 4,790,081 | A | | 12/1988 | Benoit et al. | |
| 4,796,829 | A | | 1/1989 | Pozzobon et al. | |
| 4,799,297 | A | | 1/1989 | Baggio et al. | |
| 4,802,291 | A | | 2/1989 | Sartor | |
| 4,811,503 | A | | 3/1989 | Iwama | |
| 4,826,098 | A | | 5/1989 | Pozzobon et al. | |
| 4,841,649 | A | | 6/1989 | Baggio et al. | |
| 4,856,207 | A | | 8/1989 | Datson | |
| 4,870,723 | A | | 10/1989 | Pozzobon et al. | |
| 4,870,761 | A | | 10/1989 | Tracy | |
| 4,884,760 | A | | 12/1989 | Baggio et al. | |
| 4,937,953 | A | | 7/1990 | Walkhoff | |
| 4,961,544 | A | | 10/1990 | Bidia | |
| 5,001,817 | A | | 3/1991 | De Bortoli et al. | |
| 5,016,327 | A | | 5/1991 | Klausner | |
| 5,042,177 | A | | 8/1991 | Schoch | |
| 5,062,225 | A | | 11/1991 | Gorza | |
| 5,065,480 | A | | 11/1991 | De Bortoli | |
| 5,065,481 | A | | 11/1991 | Walkhoff | |
| 5,069,586 | A | * | 12/1991 | Casey | 411/339 |
| 5,108,216 | A | | 4/1992 | Geyer et al. | |
| 5,117,567 | A | | 6/1992 | Berger | |
| 5,129,130 | A | | 7/1992 | Lecouturier | |
| 5,152,038 | A | | 10/1992 | Schoch | |
| 5,157,813 | A | | 10/1992 | Carroll | |
| 5,158,428 | A | | 10/1992 | Gessner et al. | |
| 5,167,612 | A | | 12/1992 | Bonutti | |
| 5,177,882 | A | | 1/1993 | Berger | |
| 5,178,137 | A | | 1/1993 | Goor et al. | |
| 5,181,331 | A | | 1/1993 | Berger | |
| 5,184,378 | A | | 2/1993 | Batra | |
| D333,552 | S | | 3/1993 | Berger et al. | |
| 5,213,094 | A | | 5/1993 | Bonutti | |
| 5,249,377 | A | | 10/1993 | Walkhoff | |
| 5,259,094 | A | | 11/1993 | Zepeda | |
| 5,315,741 | A | | 5/1994 | Dubberke | |
| 5,319,868 | A | | 6/1994 | Hallenbeck | |
| 5,325,613 | A | | 7/1994 | Sussmann | |
| 5,327,662 | A | | 7/1994 | Hallenbeck | |
| 5,335,401 | A | | 8/1994 | Hanson | |
| 5,341,583 | A | | 8/1994 | Hallenbeck | |
| 5,345,697 | A | | 9/1994 | Quellais | |
| 5,346,461 | A | | 9/1994 | Heinz et al. | |
| 5,353,483 | A | * | 10/1994 | Louviere | 24/712.1 |
| 5,355,596 | A | | 10/1994 | Sussmann | |
| 5,357,654 | A | | 10/1994 | Hsing-Chi | |
| 5,365,947 | A | | 11/1994 | Bonutti | |
| 5,381,609 | A | | 1/1995 | Hieblinger | |
| 5,395,304 | A | | 3/1995 | Tarr et al. | |
| 5,425,161 | A | | 6/1995 | Schoch | |
| 5,425,185 | A | | 6/1995 | Gansler | |
| 5,430,960 | A | | 7/1995 | Richardson | |
| 5,433,648 | A | | 7/1995 | Frydman | |
| 5,437,617 | A | | 8/1995 | Heinz et al. | |
| 5,456,268 | A | | 10/1995 | Bonutti | |
| 5,463,822 | A | | 11/1995 | Miller | |
| 5,477,593 | A | | 12/1995 | Leick | |
| 5,502,902 | A | | 4/1996 | Sussmann | |
| 5,511,325 | A | | 4/1996 | Hieblinger | |
| 5,535,531 | A | | 7/1996 | Karabed et al. | |
| 5,537,763 | A | | 7/1996 | Donnadieu et al. | |
| 5,557,864 | A | | 9/1996 | Marks | |
| 5,566,474 | A | | 10/1996 | Leick et al. | |

(56) References Cited

U.S. PATENT DOCUMENTS 5,596,820 A 1/1997 Edauw et al.
5,599,000 A 2/1997 Bennett
5,599,288 A 2/1997 Shirley et al.
5,600,874 A 2/1997 Jungkind
5,606,778 A 3/1997 Jungkind
D379,113 S 5/1997 McDonald et al.
5,638,588 A 6/1997 Jungkind
5,640,785 A 6/1997 Egelja
5,647,104 A 7/1997 James
5,651,198 A 7/1997 Sussmann
5,669,116 A 9/1997 Jungkind
5,685,830 A 11/1997 Bonutti
5,718,021 A 2/1998 Tatum
5,718,065 A 2/1998 Locker
5,732,483 A 3/1998 Cagliari
5,736,696 A 4/1998 Del Rosso
5,737,854 A 4/1998 Sussmann
5,755,044 A 5/1998 Veylupek
D394,745 S * 6/1998 Egelja ..... D2/999
5,761,777 A 6/1998 Leick
5,772,146 A 6/1998 Kawamoto et al.
5,784,809 A 7/1998 McDonald
5,819,378 A 10/1998 Doyle
5,833,640 A 11/1998 Vazquez, Jr. et al.
5,891,061 A 4/1999 Kaiser
5,934,599 A 8/1999 Hammerslag
5,956,823 A 9/1999 Borel
5,971,946 A 10/1999 Quinn et al.
6,029,375 A * 2/2000 Borel ..... 36/50.1
6,038,791 A 3/2000 Cornelius et al.
6,052,921 A 4/2000 Oreck
6,070,886 A 6/2000 Cornelius et al.
6,070,887 A 6/2000 Cornelius et al.
6,076,241 A * 6/2000 Borel ..... 24/712.9
6,102,412 A 8/2000 Staffaroni
D430,724 S 9/2000 Matis et al.
6,119,318 A 9/2000 Maurer
6,128,835 A 10/2000 Ritter et al.
6,128,836 A 10/2000 Barret
6,148,489 A 11/2000 Dickie et al.
6,202,953 B1 3/2001 Hammerslag
6,240,657 B1 6/2001 Weber et al.
6,256,798 B1 7/2001 Egolf et al.
6,267,390 B1 7/2001 Maravetz et al.
6,289,558 B1 9/2001 Hammerslag
6,416,074 B1 7/2002 Maravetz et al.
6,464,657 B1 10/2002 Castillo
6,467,195 B2 10/2002 Pierre et al.
6,477,793 B1 11/2002 Pruitt et al.
6,543,159 B1 4/2003 Carpenter et al.
6,568,103 B2 5/2003 Durocher
6,685,662 B1 2/2004 Curry et al.
6,689,080 B2 2/2004 Castillo
6,694,643 B1 2/2004 Hsu
6,708,376 B1 3/2004 Landry
6,711,787 B2 3/2004 Jungkind et al.
6,735,829 B2 5/2004 Hsu
6,757,991 B2 7/2004 Sussmann
6,775,928 B2 8/2004 Grande et al.
6,793,641 B2 9/2004 Freeman et al.
6,796,951 B2 9/2004 Freeman et al.
6,802,439 B2 10/2004 Azam et al.
6,877,256 B2 4/2005 Martin et al.
6,922,917 B2 8/2005 Kerns et al.
6,938,913 B2 9/2005 Elkington
6,942,632 B2 9/2005 Cho
6,945,543 B2 9/2005 De Bortoli et al.
6,962,571 B2 11/2005 Castillo
6,976,972 B2 12/2005 Bradshaw
6,993,859 B2 2/2006 Martin et al.
D521,226 S 5/2006 Douglas et al.
7,076,843 B2 7/2006 Sakabayashi
7,082,701 B2 8/2006 Dalgaard et al.
7,134,224 B2 11/2006 Elkington et al.
7,182,740 B1 2/2007 Castillo
7,198,610 B2 4/2007 Ingimundarson et al.
7,281,341 B2 10/2007 Reagan et al.
7,293,373 B2 11/2007 Reagan et al.
7,314,458 B2 1/2008 Bodenschatz
7,331,126 B2 2/2008 Johnson
7,367,522 B2 5/2008 Chen
7,386,947 B2 6/2008 Martin et al.
7,402,147 B1 7/2008 Allen
7,490,458 B2 2/2009 Ford
7,516,914 B2 4/2009 Kovacevich et al.
7,584,528 B2 9/2009 Hu
7,591,050 B2 9/2009 Hammerslag
7,597,675 B2 10/2009 Ingimundarson et al.
7,600,660 B2 10/2009 Kasper et al.
7,617,573 B2 11/2009 Chen
7,618,386 B2 11/2009 Nordt, III et al.
7,618,389 B2 11/2009 Nordt, III et al.
7,648,404 B1 1/2010 Martin
7,650,705 B2 * 1/2010 Donnadieu et al. ..... 36/50.5
7,658,019 B2 * 2/2010 Reagan et al. ..... 36/50.1
7,662,122 B2 2/2010 Sterling
7,694,354 B2 4/2010 Philpott et al.
7,704,219 B2 4/2010 Nordt, III et al.
7,713,225 B2 5/2010 Ingimundarson et al.
7,789,844 B1 9/2010 Allen
7,794,418 B2 9/2010 Ingimundarson et al.
7,806,842 B2 10/2010 Stevenson et al.
7,819,830 B2 10/2010 Sindel et al.
7,871,334 B2 1/2011 Young et al.
7,877,845 B2 2/2011 Signori
7,878,998 B2 2/2011 Nordt, III et al.
7,887,500 B2 2/2011 Nordt, III et al.
7,908,769 B2 3/2011 Pellegrini
7,922,680 B2 4/2011 Nordt, III et al.
7,935,068 B2 5/2011 Einarsson
7,947,005 B2 5/2011 Castillo
7,950,112 B2 5/2011 Hammerslag et al.
7,954,204 B2 6/2011 Hammerslag et al.
7,963,049 B2 6/2011 Messmer
7,992,261 B2 8/2011 Hammerslag et al.
7,993,296 B2 8/2011 Nordt, III et al.
8,016,781 B2 9/2011 Ingimundarson et al.
D646,790 S 10/2011 Castillo et al.
8,056,150 B2 11/2011 Stokes et al.
8,074,379 B2 12/2011 Robinson, Jr. et al.
8,091,182 B2 1/2012 Hammerslag et al.
8,105,252 B2 1/2012 Rousso
8,109,015 B2 2/2012 Signori
8,128,587 B2 3/2012 Stevenson et al.
7,591,050 C1 4/2012 Hammerslag
D663,850 S 7/2012 Joseph
D663,851 S 7/2012 Joseph
8,231,074 B2 7/2012 Hu et al.
8,231,560 B2 7/2012 Ingimundarson et al.
D665,088 S 8/2012 Joseph
8,245,371 B2 8/2012 Chen
8,277,401 B2 10/2012 Hammerslag et al.
8,277,404 B2 10/2012 Einarsson
8,303,527 B2 11/2012 Joseph
8,308,098 B2 11/2012 Chen
8,381,362 B2 2/2013 Hammerslag et al.
8,424,168 B2 4/2013 Soderberg et al.
8,679,042 B2 3/2014 Kausek
2002/0052568 A1 5/2002 Houser et al.
2002/0095750 A1 7/2002 Hammerslag
2002/0178548 A1 12/2002 Freed
2003/0126726 A1 * 7/2003 Hsu ..... 24/712.1
2003/0177662 A1 9/2003 Elkington et al.
2005/0081403 A1 4/2005 Mathieu
2005/0087115 A1 4/2005 Martin
2005/0098673 A1 5/2005 Huang
2005/0102861 A1 5/2005 Martin
2005/0198866 A1 9/2005 Wiper et al.
2005/0273025 A1 12/2005 Houser
2006/0075659 A1 * 4/2006 Reagan et al. ..... 36/50.5
2006/0107447 A1 * 5/2006 Augustine et al. ..... 2/455
2006/0156517 A1 7/2006 Hammerslag
2006/0179685 A1 8/2006 Borel et al.
2007/0113524 A1 5/2007 Lander

(56) References Cited

U.S. PATENT DOCUMENTS

| | | | | |
|---|---|---|---|---|
| 2007/0128959 | A1 | 6/2007 | Cooke | |
| 2007/0169378 | A1 | 7/2007 | Soderberg | |
| 2007/0276306 | A1 | 11/2007 | Castillo | |
| 2008/0016717 | A1 | 1/2008 | Ruban | |
| 2008/0060167 | A1 | 3/2008 | Hammerslag | |
| 2008/0060168 | A1 | 3/2008 | Hammerslag | |
| 2008/0066272 | A1 | 3/2008 | Hammerslag | |
| 2009/0019734 | A1* | 1/2009 | Reagan et al. | 36/115 |
| 2009/0124948 | A1 | 5/2009 | Ingimundarson et al. | |
| 2009/0172928 | A1 | 7/2009 | Messmer et al. | |
| 2009/0172929 | A1* | 7/2009 | Hwang | 24/712.1 |
| 2009/0184189 | A1 | 7/2009 | Soderberg | |
| 2009/0229087 | A1* | 9/2009 | Schneider | 24/197 |
| 2009/0276981 | A1* | 11/2009 | Thompson | 24/115 R |
| 2009/0282653 | A1* | 11/2009 | Yang | 24/129 R |
| 2009/0287128 | A1 | 11/2009 | Ingimundarson et al. | |
| 2010/0081979 | A1 | 4/2010 | Ingimundarson et al. | |
| 2010/0094189 | A1 | 4/2010 | Ingimundarson et al. | |
| 2010/0101061 | A1 | 4/2010 | Ha | |
| 2010/0139057 | A1 | 6/2010 | Soderberg | |
| 2010/0154254 | A1 | 6/2010 | Fletcher | |
| 2010/0174221 | A1 | 7/2010 | Ingimundarson et al. | |
| 2010/0175163 | A1 | 7/2010 | Litke | |
| 2010/0217169 | A1 | 8/2010 | Ingimundarson | |
| 2010/0299959 | A1 | 12/2010 | Hammerslag | |
| 2010/0319216 | A1 | 12/2010 | Grenzke et al. | |
| 2010/0331750 | A1 | 12/2010 | Ingimundarson | |
| 2011/0000173 | A1 | 1/2011 | Lander | |
| 2011/0004135 | A1 | 1/2011 | Kausek | |
| 2011/0071647 | A1 | 3/2011 | Mahon | |
| 2011/0098618 | A1 | 4/2011 | Fleming | |
| 2011/0144554 | A1 | 6/2011 | Weaver, II et al. | |
| 2011/0167543 | A1 | 7/2011 | Kovacevich et al. | |
| 2011/0178448 | A1 | 7/2011 | Einarsson | |
| 2011/0184326 | A1 | 7/2011 | Ingimundarson et al. | |
| 2011/0197362 | A1 | 8/2011 | Chella et al. | |
| 2011/0218471 | A1 | 9/2011 | Ingimundarson et al. | |
| 2011/0225843 | A1 | 9/2011 | Kerns et al. | |
| 2011/0258876 | A1 | 10/2011 | Baker et al. | |
| 2011/0266384 | A1 | 11/2011 | Goodman et al. | |
| 2011/0288461 | A1 | 11/2011 | Arnould et al. | |
| 2011/0301521 | A1 | 12/2011 | Weissenbock et al. | |
| 2011/0306911 | A1 | 12/2011 | Tran | |
| 2012/0005995 | A1 | 1/2012 | Emery | |
| 2012/0010547 | A1 | 1/2012 | Hinds | |
| 2012/0029404 | A1 | 2/2012 | Weaver, II et al. | |
| 2012/0101417 | A1 | 4/2012 | Joseph | |
| 2012/0102783 | A1 | 5/2012 | Swigart et al. | |
| 2012/0157902 | A1 | 6/2012 | Castillo et al. | |
| 2012/0228419 | A1 | 9/2012 | Chen | |
| 2012/0246974 | A1 | 10/2012 | Hammerslag et al. | |
| 2012/0253252 | A1 | 10/2012 | Weaver, II | |
| 2013/0012856 | A1 | 1/2013 | Hammerslag et al. | |
| 2013/0025100 | A1 | 1/2013 | Ha | |
| 2013/0092780 | A1 | 4/2013 | Soderberg et al. | |
| 2013/0269219 | A1 | 10/2013 | Nickel et al. | |
| 2013/0277485 | A1 | 10/2013 | Soderberg et al. | |
| 2014/0117140 | A1 | 5/2014 | Goodman et al. | |

FOREIGN PATENT DOCUMENTS

| | | | |
|---|---|---|---|
| CA | 2112789 | | 8/1994 |
| CA | 2114387 | | 8/1994 |
| CH | 41765 | | 9/1907 |
| CH | 111341 | | 11/1925 |
| CH | 199766 | | 11/1938 |
| CH | 204 834 | A | 8/1939 |
| CN | 2613167 | Y | 4/2004 |
| CN | 201015448 | Y | 2/2008 |
| DE | 555211 | | 7/1932 |
| DE | 641976 | | 2/1937 |
| DE | 1 661 668 | | 8/1953 |
| DE | 7043154 | | 3/1971 |
| DE | 7045778 | | 3/1971 |
| DE | 1 785 220 | | 5/1971 |
| DE | 2 062 795 | | 6/1972 |
| DE | 7047038 | | 1/1974 |
| DE | 23 41 658 | | 3/1974 |
| DE | 24 14 439 | | 10/1975 |
| DE | 29 00 077 | A1 | 7/1980 |
| DE | 29 14 280 | A1 | 10/1980 |
| DE | 31 01 952 | A1 | 9/1982 |
| DE | 81 01 488 | | 7/1984 |
| DE | 38 13 470 | A1 | 11/1989 |
| DE | 3822113 | C2 | 1/1990 |
| DE | 43 02 401 | A1 | 8/1994 |
| DE | 94 13 147 | U | 10/1994 |
| DE | 93 15 776 | | 2/1995 |
| DE | 295 03 552 | | 4/1995 |
| DE | 196 24 553 | A1 | 1/1998 |
| DE | 19945045 | A1 | 9/1999 |
| DE | 201 16 755 | U1 | 1/2002 |
| EP | 0 589 232 | A1 | 3/1994 |
| EP | 0 589 233 | A1 | 3/1994 |
| EP | 0 614 624 | | 9/1994 |
| EP | 0 614 625 | A1 | 9/1994 |
| EP | 0 651 954 | A1 | 5/1995 |
| EP | 0 693 260 | B1 | 1/1996 |
| EP | 0 734 662 | A1 | 10/1996 |
| EP | 1 236 412 | A1 | 9/2002 |
| FR | 1 349 832 | | 1/1964 |
| FR | 1 374 110 | | 10/1964 |
| FR | 1 404 799 | | 7/1965 |
| FR | 2 019 991 | A | 7/1970 |
| FR | 2 108 428 | | 5/1972 |
| FR | 2 173 451 | | 10/1973 |
| FR | 2 175 684 | | 10/1973 |
| FR | 2 399 811 | | 3/1979 |
| FR | 2 565 795 | A1 | 12/1985 |
| FR | 2 598 292 | A1 | 11/1987 |
| FR | 2 770 379 | A1 | 5/1999 |
| FR | 2 814 919 | A1 | 4/2002 |
| GB | 11673 | | 6/1899 |
| GB | 216400 | | 5/1924 |
| GB | 2 449 722 | A | 5/2007 |
| IT | 1220811 | | 3/1998 |
| IT | PD 2003 A 000197 | | 3/2005 |
| IT | PD 2003 A 000198 | | 3/2005 |
| JP | 8-9202 | | 6/1933 |
| JP | 49-28618 | | 3/1974 |
| JP | 51-2776 | | 1/1976 |
| JP | 51-121375 | | 10/1976 |
| JP | 51-131978 | | 10/1976 |
| JP | 53-124987 | | 3/1977 |
| JP | 54-108125 | | 1/1978 |
| JP | 62-57346 | | 4/1987 |
| JP | 63-80736 | | 5/1988 |
| JP | 3030988 | | 3/1991 |
| JP | 7-208 | | 1/1995 |
| JP | 3031760 | | 2/1996 |
| JP | 8-131201 | | 5/1996 |
| JP | 8308608 | | 11/1996 |
| JP | 10-199366 | | 7/1998 |
| JP | 2004-016732 | | 1/2004 |
| JP | 2004-041666 | | 2/2004 |
| KR | 20-0367882 | | 11/2004 |
| KR | 20-0400568 | | 11/2005 |
| KR | 10-0598627 | | 7/2006 |
| KR | 10-0953398 | | 4/2010 |
| KR | 10-1028468 | | 4/2011 |
| WO | WO 94/27456 | | 12/1994 |
| WO | WO 95/03720 | | 2/1995 |
| WO | WO 98/37782 | | 9/1998 |
| WO | WO 99/15043 | A1 | 4/1999 |
| WO | WO 99/43231 | | 9/1999 |
| WO | WO 00/53045 | | 9/2000 |
| WO | WO 00/76337 | A1 | 12/2000 |
| WO | WO 01/08525 | A1 | 2/2001 |
| WO | WO 2007/016983 | A1 | 2/2007 |
| WO | WO 2008/015214 | | 2/2008 |

OTHER PUBLICATIONS

U.S. Appl. No. 14/268,498, filed May 2, 2014, Kerns, et al.

(56) References Cited

OTHER PUBLICATIONS

U.S. Appl. No. 13/793,919, filed Mar. 11, 2013, Cotterman, et al.
U.S. Appl. No. 13/865,951, filed Apr. 18, 2013, Soderberg.
International Search Report and Written Opinion for PCT/US2011/042709 dated Feb. 24, 2012 in 9 pages.
International Preliminary Report on Patentability for PCT/US2011/042709 dated Jan. 8, 2013 in 5 pages.
ASOLO® Boot Brochure Catalog upon information and belief date is as early as Aug. 22, 1997.
U.S. Appl. No. 09/956,601, filed Sep. 18, 2001, Gary R. Hammerslag.
U.S. Appl. No. 13/174,533, filed Jun. 30, 2011, Michael J. Nickel, et al.
U.S. Appl. No. 13/273,060, filed Oct. 13, 2011, Soderberg, et al.

* cited by examiner

LACE GUIDE

CROSS-REFERENCE TO RELATED APPLICATIONS

This application claims priority under 35 U.S.C. §119(e) to U.S. Provisional Patent Application No. 61/360,636, filed Jul. 1, 2010, and titled "LACE GUIDE," the entirety of which is hereby incorporated by reference and made a part of this specification for all that it discloses.

BACKGROUND OF THE INVENTION

1. Field of the Invention

Embodiments of the present invention relate to lacing systems for wearable articles (e.g., shoes, bags, clothing, etc.), and more particularly to lace guides for use with lacing systems.

2. Description of the Related Art

Although various lacing systems are available for use in connection with various wearable articles, there remains a need for improved lace guides for use with lacing systems.

SUMMARY OF THE INVENTION

In an example embodiment, a lace guide can include a lace channel configured to slidably receive a lace, a first opening at a first end of the lace channel, an axis extending out of the lace channel through the first opening, a second opening at a second end of the lace channel, and a first flange positioned at the first opening. The first flange can have a lower portion positioned below the first opening and an upper portion positioned above the first opening, and the lower portion can extend axially further away from the lace channel than does the upper portion such that the lower portion forms a sliding surface for the lace to slide on as the lace moves through the lace guide.

The lace guide can further include a second flange positioned at the second opening, and the second flange can have a lower portion that extends axially away from the lace channel to form a sliding surface for the lace to slide on as the lace moves through the lace guide.

The first flange can be shaped such that a line drawn from the end of the lower portion of the first flange to the end of the upper portion of the first flange is angled with respect to the lace channel by an angle between about 5° and about 85°. The first flange can be shaped such that a line drawn from the end of the lower portion of the first flange to the end of the upper portion of the first flange is angled with respect to the lace channel by an angle between about 10° and about 80°. The first flange can be shaped such that a line drawn from the end of the lower portion of the first flange to the end of the upper portion of the first flange is angled with respect to the lace channel by an angle between about 30° and about 60°. The first flange can be shaped such that a line drawn from the end of the lower portion of the first flange to the end of the upper portion of the first flange is angled with respect to the lace channel by an angle of about 45°.

The lower portion of the first flange can include a curved surface providing at least a portion of the sliding surface for the lace, the curved surface having a radius of curvature between about 2 millimeters and about 10 millimeters. The lower portion of the first flange can include a curved surface providing at least a portion of the sliding surface for the lace, the curved surface having a radius of curvature between about 4 millimeters and about 8 millimeters. The lower portion of the first flange can include a curved surface providing at least a portion of the sliding surface for the lace, the curved surface having a radius of curvature of about 5 millimeters.

The lace channel can include a main channel configured to receive the lace, and an open channel that connects the main channel to outside the lace guide, and at least a portion of the main channel can be wider than the open channel thereby forming a front undercut along a front side of the main channel and a back undercut along the back side of the main channel.

In some embodiments, a lace can have an outer surface, and at least the sliding surface on the first flange can be formed from a material that is softer than the outer surface of the lace. In some embodiments, the at least a portion of the main channel can be formed from a material that is softer than the outer surface of the lace.

In another example embodiment, a lace guide can include a lace channel configured to slidably receive a lace, the lace channel providing a curved lace path through the lace guide; a first opening at a first end of the lace channel; a second opening at a second end of the lace channel; and a first flange positioned at the first opening, the first flange having a lower portion that extends away from the lace channel to form a sliding surface for the lace to slide on as the lace moves through the lace guide.

The lace channel can be at least about 10 mm in length. The lace channel can be substantially U-shaped such that lace channel has a first direction at the first opening and a second direction at the second opening. In some embodiments, the first opening faces in a first direction and is configured to direct the lace generally in the first direction and the second opening can face in a second direction and can be configured to direct the lace generally in the second direction. An angle formed between the first direction and the second direction can be less than about 45°. The angle formed between the first direction and the second direction can be less than about 30°. The angle formed between the first direction and the second direction can be less than about 15°. The first direction can be substantially parallel to the second direction.

A method of securing a lace guide to an article is disclosed. The method can include providing a lace guide having a lace channel, a first opening at a first end of the lace channel, a second opening at a second end of the lace channel, a first flange positioned at the first opening, and a second flange positioned at the second opening; placing an upper layer over the lace guide, wherein the upper layer has a first hole and a second hole; and passing the first and second flanges through the corresponding first and second holes in the upper layer.

The method can further include securing the lace guide to a liner, and securing the upper layer to the liner.

A lace guide secured to an article is disclosed that can include a lace guide having a lace channel, a first opening at a first end of the lace channel, a second opening at a second end of the lace channel, a first flange positioned at the first opening, and a second flange positioned at the second opening. An upper layer can be positioned over the lace guide. The upper layer can include a first hole and a second hole, and the first and second flanges can pass through the corresponding first and second holes such that the first and second flanges are positioned above the upper layer while the lace channel is positioned below the upper layer.

The lace guide can be secured to a liner and the upper layer can be secured to the liner. A stitch flange can be attached to the lace channel, and stitching can secure the stitch flange to the article.

A lace guide secured to an article is disclosed that can include an article having a first side and a second side, and a lace guide positioned on the first side of the article. The lace guide can include a lace channel, a first opening at a first end of the lace channel, a second opening at a second end of the lace channel, a first flange positioned at the first opening, and a second flange positioned at the second opening. The lace channel can have a first direction at the first opening and a second direction at the second opening. An angle formed between the first direction and the second direction can be less than about 45°. The first side of the article can have an outer layer with a first hole and a second hole formed therein and displaced from an edge of the first side of the article. The first and second flanges can be positioned outside of the outer layer and the lace channel can be positioned inside of the outer layer.

A lace guide is disclosed that can include a lace channel configured to slidably receive a lace, a first opening at a first end of the lace channel, a second opening at a second end of the lace channel. The lace channel can have a first direction at the first opening and a second direction at the second opening. An angle formed between the first direction and the second direction can be less than about 45°. The lace channel can be curved and configured to provide no more than four points of contact between the lace guide and the lace when tension applied to the lace is below a threshold level.

A first point of contact can be at the first opening, a second point of contact can be at the second opening, a third point of contact can be located inside the lace channel, and a fourth point of contact can be located inside the lace channel.

A lace guide secured to an article is disclosed that can include an upper layer of the article, a lace channel positioned under the upper layer such that the lace channel is hidden from view, a first opening at a first end of the lace channel, a second opening at a second end of the lace channel, and a first bell-shaped end piece positioned at the first opening. The first bell-shaped end piece can be positioned outside of the upper layer such that the first bell-shaped end piece is visible.

In some embodiments, a second bell-shaped end piece can be positioned at the second opening, and the second bell-shaped end piece can be positioned outside of the upper layer such that the second bell-shaped end piece is visible.

BRIEF DESCRIPTION OF THE DRAWINGS

Various embodiments are depicted in the accompanying drawings for illustrative purposes, and should in no way be interpreted as limiting the scope of the inventions.

DETAILED DESCRIPTION OF THE PREFERRED EMBODIMENTS

Figure 1:
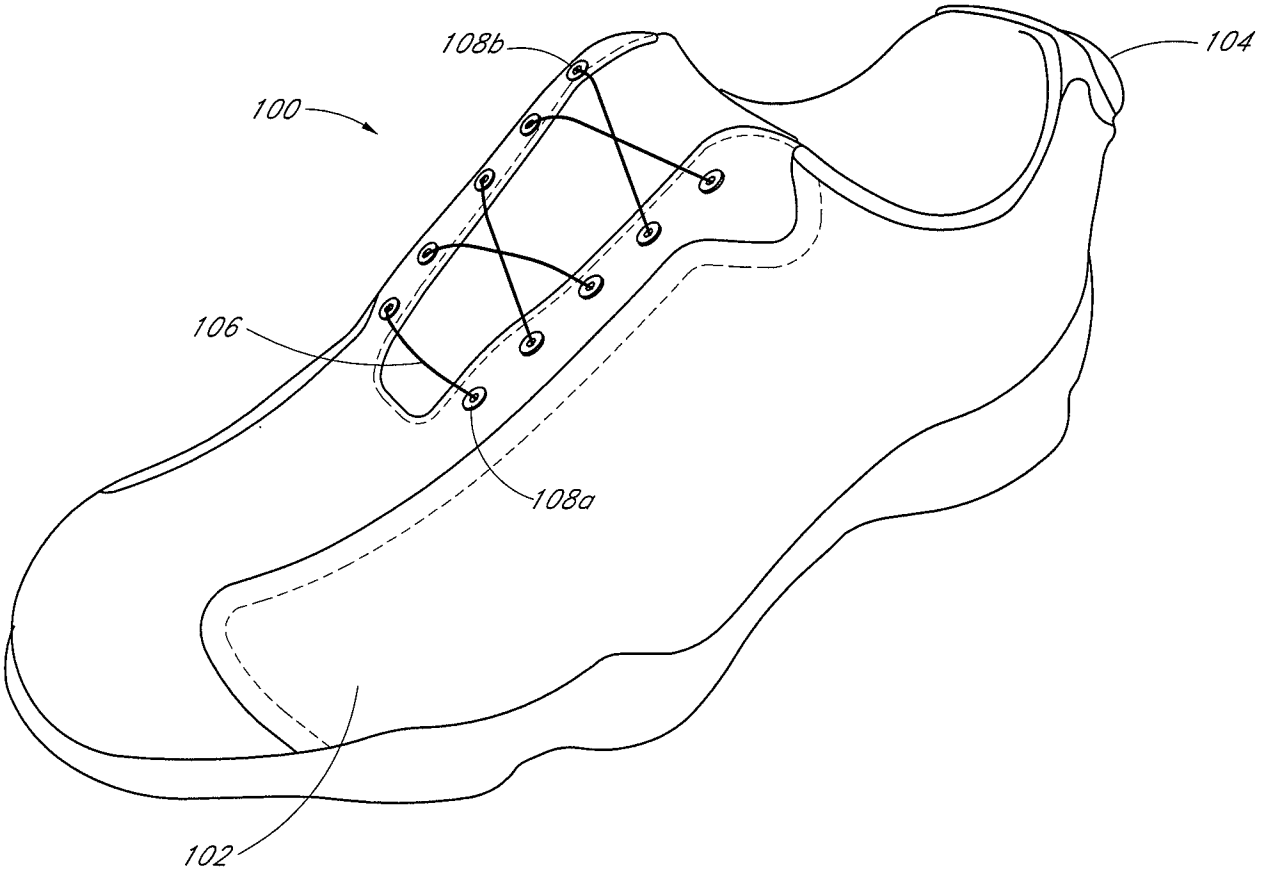
FIG. 1 is a perspective view of a lacing system used to tighten a shoe.

FIG. 1 is a perspective view of a lacing system 100 used for tightening a shoe 102. Although various embodiments described herein are discussed in the context of tightening a shoe, the lacing system disclosed herein can likewise be used to tighten other objects, including but not limited to gloves, hats, belts, braces, boots, jackets, pants, or other wearable articles. The lacing system 100 can include a mechanism for imparting and/or holding tension on a lace. For example, the lacing system 100 can include a lace winder 104 configured to draw a lace 106 into the lace winder 104 as a knob of the lace winder 104 is twisted. The lace winder 104 can be positioned on the back of the shoe, as is shown in FIG. 1, or on the side or tongue of the shoe 102, or in any other suitable position that allows the lace 106 to be fed into and out of the lace winder 104. In some embodiments, the lacing system 100 may include more than one lace winder or other mechanism for holding the tension on the lace or may not include any such mechanism.

The lace 106 used with the lacing system 100 can be a variety of different lace types. In some embodiments, the lace can be made of stranded steel cable with no coating, stranded steel cable with a polymer coating (e.g., nylon coating), monofilament (e.g., nylon), or braided Spectra®. Preferably, the lace 106 has a modulus of elasticity of at least about 20,000 psi and/or no more than about 1,000,000 psi. The lace 106 can have a diameter of at least about 0.015 inches and preferably no more than about 0.1 inches, although diameters outside these ranges can also be used. In some embodiments the lace 106 can have a diameter of about 0.03 inches.

The lacing system can include one or more lace guides 108 configured to guide the lace 106 through the lacing system 100 so that the sides of the shoe 102 or other article are drawn together when the lace 106 tightened by, for example, the lace winder 104. The lace guides 108 can be configured to reduce or minimize friction thereby substantially evenly distribute the force imposed by the tightened lace 106 along the lacing zone, thereby avoiding pressure points which can cause discomfort and impaired performance. The guides 108 can provide a lace path that resists allowing the lace 106 to turn about any sharp corners of less than about a 5 mm radius when the lace 106 is tightened. In some embodiments, the guides can provide a lace path that includes no corners of less than about a 3 mm radius, or no corners of less than about a 7 mm radius, or no corners of less than about a 10 mm radius, although curvatures outside of these ranges are also possible.

The reduction or elimination of sharp turns from the lace path can prevent fatigue of the lace 106 and can reduce the friction and wear on lace 106 and on the guides 108 as well. Removing sharp turns from the lace path can be increasingly advantageous in embodiments where laces of larger diameters, and harder, less flexible, materials are used. In some embodiments, harder and less flexible laces (e.g., steel cable laces) can allow for increased tension to be applied to the lacing system. The lacing system 100 can be configured to tighten with about 2.5 pounds of force in some embodiments, although a much higher tension of up to about 100 pounds can be used in some embodiments (e.g., snowboard boots). When the force is concentrated on a smaller lace thickness, and the force is not significantly absorbed by a softer lace material, and the force is not significantly absorbed by stretching of the lace, it can be particularly advantageous to avoid sharp turns in the lace path.

Figure 2:
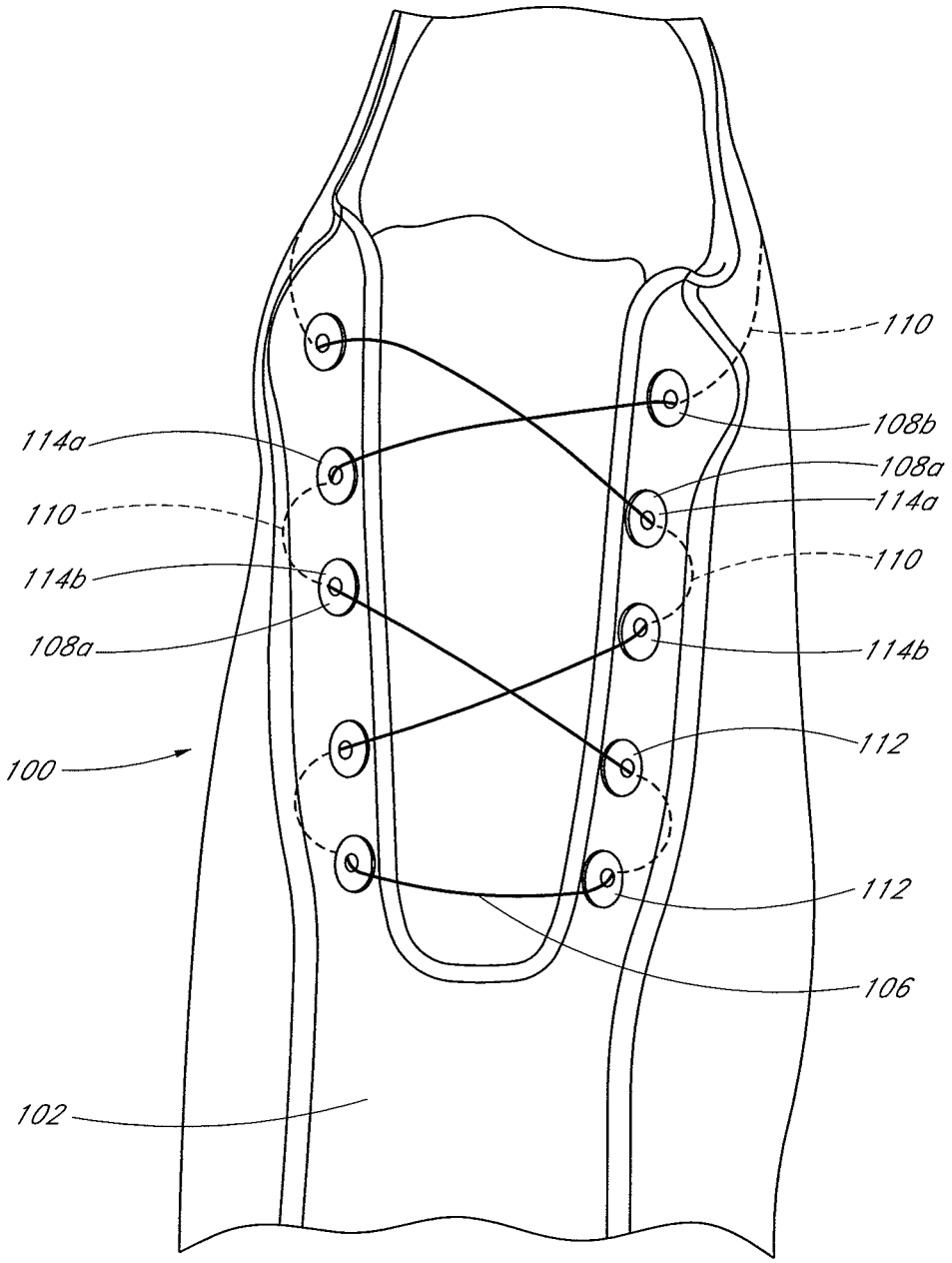
FIG. 2 is another perspective view of the lacing system.

In some embodiments, a hidden portion of the lace guides 108 can be disposed under a portion of the article such that the hidden portion is hidden or substantially hidden from view, and an exposed portion of the lace guides 108 can be disposed on the exterior of the article such that the exposed portion is visible. For example, in some embodiments, the one or more of the lace guides 108 can include a lace channel 110 that is disposed under a portion of the shoe or other article. In some embodiments, the covering portion of the shoe or article is opaque or substantially opaque and substantially hides the channel 110. FIG. 2 is another view of the lacing system 100 and shoe 102 with the lace channels 110 shown schematically by dotted lines that follow the path of the lace 106 through the lace guides 108. In some embodiments, one or more of the lace guides 108 can include an end piece 112 positioned at the end of a lace channel 110 such that the end piece 112 is positioned on the exterior of the article where it is exposed and visible.

Disposing a portion of the lace guides 108 within the shoe can provide the shoe with a more aesthetically pleasing appearance, can protect portions of the lace guides 108 from damage, can prevent items from becoming snagged on external lace guides (especially during sports activities), can allow for the use of deeper lace paths that more accurately follow the natural curvature of the lace 106, and can permit the use of softer materials for some or all of the lace guide 108. In some embodiments, the exposed end pieces 112 of the lace guides 108 can have an appearance similar to conventional shoelace eyelets which can be a desirable aesthetic feature. In some embodiments, the end pieces 112 can be have a non-uniform flange extending around at least a portion of the openings to the lace channels 110. The end pieces can be, for example, substantially bell-shaped and can provide a curved sliding surface for the lace 106 to ride against as it is tightened, to prevent the lace 106 from turning a tight corner as it enters or exits the lace guide 108 and reduce friction and wear on the lace 106 and on the lace guide 108. Thus, some embodiments provide the appearance of spaced apart eyelets while still providing a structured lace channel between the eyelets.

In some instances, the lacing system 100 can use one or more double-end-piece lace guides 108*a*. For example, as can be seen in FIG. 2, a double-end-piece lace guide 108*a* can have a generally U-shaped lace channel 110 that connects a first opening 114*a* and a second opening 114*b*, and each of the first and second openings 114*a-b* can have an exposed end piece 112 attached thereto. In some embodiments, the end pieces 112 are spaced away from the edges of the shoe that are drawn together by the lacing system. By spacing the lace guides 108 away from the edges, tension applied to the lace 106 can be more evenly distributed than if the openings to the lace guides were positioned directly on or adjacent to the edges. Distributing the tension from the opening to the edge may facilitate movement of the edge across the tongue, reducing the likelihood of tongue bunching.

In some instances, the lacing system 100 can use one or more single-end-piece lace guides 108*b*. A single-end-piece lace guide 108*b* can have a lace channel 110 with a first opening 114*a* that includes an exposed end piece 112, while the second opening 114*b* at the other end of the lace channel 100 does not include an exposed end piece 112. The unexposed opening 114*b* can, for example, direct the lace 106 toward the lace winder 104, as is the case in FIGS. 1-2.

Figure 3:
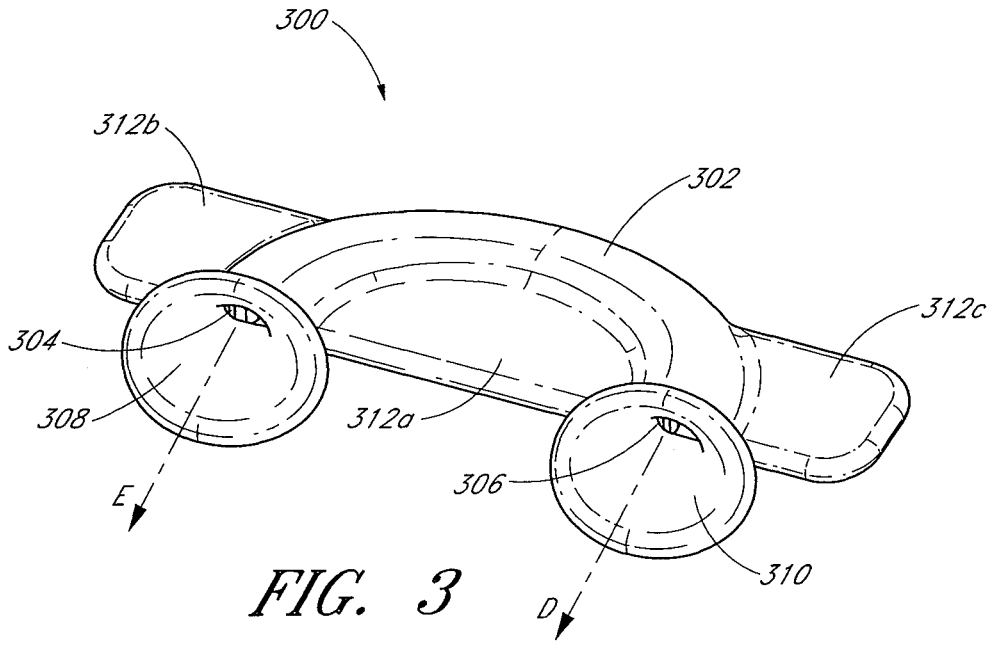
FIG. 3 is a perspective view of a lace guide for use with a lacing system.
Figure 4:
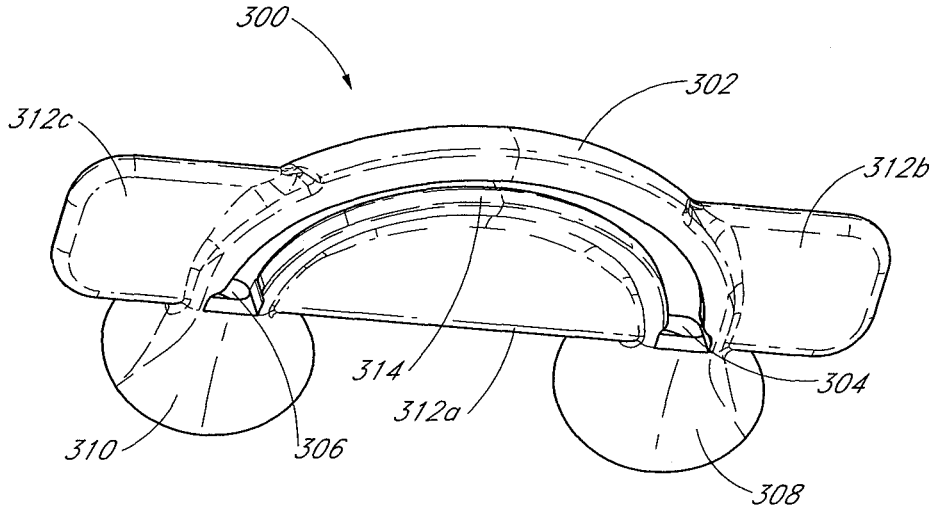
FIG. 4 is another perspective view of the lace guide.

FIG. 3 is a top-front perspective view of a double-end-piece lace guide 300. FIG. 4 is a bottom-rear perspective view of the lace guide 300. The lace guide 300 can include a lace channel 302 with a first opening 304 at a first end of the lace channel 302 and a second opening 306 as a second end of the lace channel 302. In the illustrated embodiment, the lace channel 302 is generally U-shaped, although the lace channel 302 can follow a path having other shapes. For example, the lace channel 302 can be generally linear, or generally S-shaped, etc. A first end piece 308 can be positioned at the first opening 304 and a second end piece 310 can be positioned at the second opening 306. The end pieces 308, 310 can be generally bell-shaped, as shown in the illustrated embodiments, but other shapes can also be used. The lace guide 300 can include a stitch flange 312, which can, for example, have a middle portion 312*a* that extends between portions of the lace channel 302, a first end portion 312*b* that extends away from the lace channel 302 in a first direction, and a second end portion 312*c* that extends away from the lace channel 302 in a second direction.

In some embodiments, the lace guide 300 can be formed as a single integral piece. Various materials and processes can be used to form the lace guide 300. For example, the lace guide can be injection molded or otherwise formed from any suitable polymeric material, such as nylon, PVC or PET. In some embodiments, at least some portions of the lace guide 300 can be can be formed from a lubricious plastic such as PTFE, or other material useful in reducing the friction between a lace and portions of the lace guide configured to interact with the lace. In some embodiments, portions of the lace guide 300 can be coated, impregnated, blended, or layered with a lubricious material to reduce the friction with interacting components or parts. In some embodiments, the lace guide 300 can be formed from a material that is generally rigid or semi-rigid. In some embodiments, the lace guide 300 can be generally flexible, so that it can conform to the shape of a shoe (or other article) associated with the lace guide 300, especially in cases in which the shoe may bend when in use.

Figure 5:
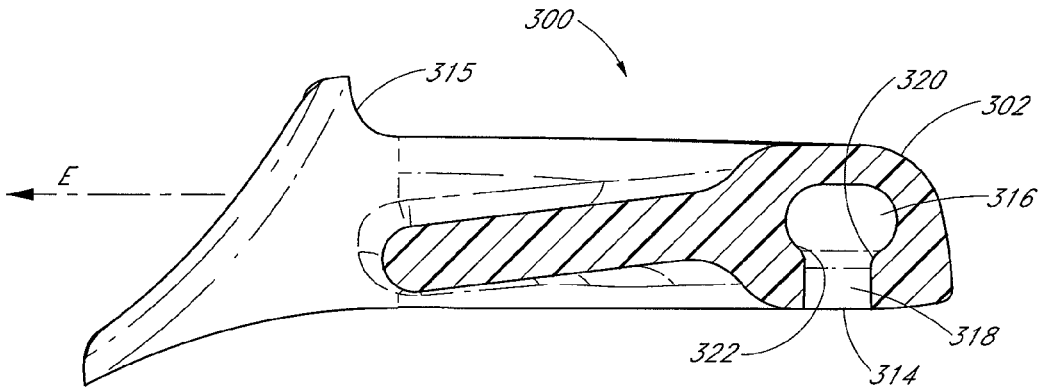
FIG. 5 is a cross-sectional view of the lace guide shown in FIG. 3.

In some embodiments, the lace channel 302 can have an open bottom. FIG. 5 is a cross-sectional view of the lace guide 300 taken through a midline through the lace guide 300. The lace channel 302 can include a main channel 316 that is configured to receive a lace, and an open channel 318 that provides an opening from the main channel 316 to the exterior of the lace guide 300 via the open bottom 314 and can facilitate and can facilitate the manufacture thereof. In some embodiments, open channel 318 can be thinner than the main channel 316. For example, the open channel 318 can be thinner than the lace received by the main channel 316 such that the lace does not exit the lace channel 302 via the open channel 318 or become wedged in the open channel 318. In some embodiments, the open channel 318 can be at least about 0.5 mm wide, and/or no more than about 1.5 mm wide, and in some instances can be about 1.0 mm wide, although other dimensions outside of these ranges can be used, especially depending on the diameter of the lace to be used. The main channel 316 can be at least about 1.0 mm wide, and/or no more than about 3.0 wide, and in some instances can be about 2.0 mm wide, although other dimensions outside of these ranges can be used, especially depending on the diameter of the lace to be used. In some embodiments, the main channel 316 can be about twice as wide as the open channel 318. In some embodiments, the main channel 316 may vary in size from one opening to the other.

A back undercut 320 can be formed at the transition from the main channel 316 to the open channel 318 on the back side of the lace channel 302. The back undercut 320 can be curved as shown, or it can be an angled step. The back undercut 320 can facilitate the initial threading of the lace through the lace channel 302, for example, by preventing the lace from dropping down into the open channel 318. A front undercut 322 can be formed at the transition between the main channel 316 and the open channel 318 on the front side of the lace channel 302. The front undercut 322 can aid in keeping the lace in proper position in the main channel 316 when tightened. In some embodiments, the front undercut 322, the back undercut 320, and/or both may be eliminated along some or all of the lace channel 302.

The open bottom 314 of the lace guide 300 can facilitate the molding of the lace guide 300. The lace guide 300, or at least the lace channel 302 portion thereof, can be injection molded with an insert piece used to form the main channel 316 and the open channel 318. The insert piece can have a wider top portion and a narrower lower portion that correspond to the wider main channel 316 and narrower open channel 318. Once the lace guide 300 is molded, the insert piece can be removed from the lace channel 302 by applying a force that pulls the insert piece out through the open bottom 314. In some embodiments, the walls of the lace channel 302 can flex as the wide top portion of the insert piece passes through the narrow open channel 318.

To facilitate removal of the insert piece, in some embodiments, the lace guide 300, or at least the lace channel 302 portion thereof, can be made of a somewhat soft or flexible material. However, in some embodiments, a material is used that is hard enough to withstand the tension applied by the lacing system without damaging the lace guide 300 or tearing out stitches or other fasteners that attach the lace guide 300 to the shoe. Furthermore, in some embodiments, the lace guide 300, or at least the portions of the lace guide 300 that contact the lace during use, can be formed from a material that is softer than the outer surface of the lace. Thus, after repeated use, the softer material of the lace guide 300 will wear before the outer surface of the lace. This can be advantageous in some embodiments because wearing out the outer surface of the lace can expose the inner layers of the lace and can weaken the lace or give the appearance that integrity of the lace has been compromised even when it hasn't. If the lace guide 300 is made of a material that is softer than the outer surface of the lace, then lace guide 300 will tend to wear down instead of the lace thereby preserving lace integrity and the appearance thereof. Because some of the contact points between the lace guide 300 and the lace are inside the lace channel 302, the worn portion of the lace guide can be hidden from view. In some embodiments, a material can be used to form the lace guide that has a hardness of at least about 60 Shore D and/or no more than about 85 Shore D, although other hardness values can also be used. In some embodiments, different portions of the lace guide 300 can have different levels of hardness. For example, in some embodiments, the stitch flange 312 can be formed from a harder material that the lace channel 302, for example, by overmolding the stitch flange over the lace channel 302. A differential of 5 to 25 Shore D could be advantageous. Thus, the lace channel 302 can be configured to bend and flex with the shoe (or other article) during use, while the stitch flange 312 can remain relatively rigid to hold the lace guide 300 in place. The harder material of the stitch flange 312 can also reduce the likelihood that stitches will tear through the stitch flange 312.

In some embodiments, the lace guide 300 can be formed from multiple pieces. For example, the lace channel 302 can be formed as a separate piece than the end pieces 308, 310 which can be attached to the ends of the lace channel 302 using an adhesive, sonic welding, a snap fit structure, or any other suitable attachment method.

Figure 6:
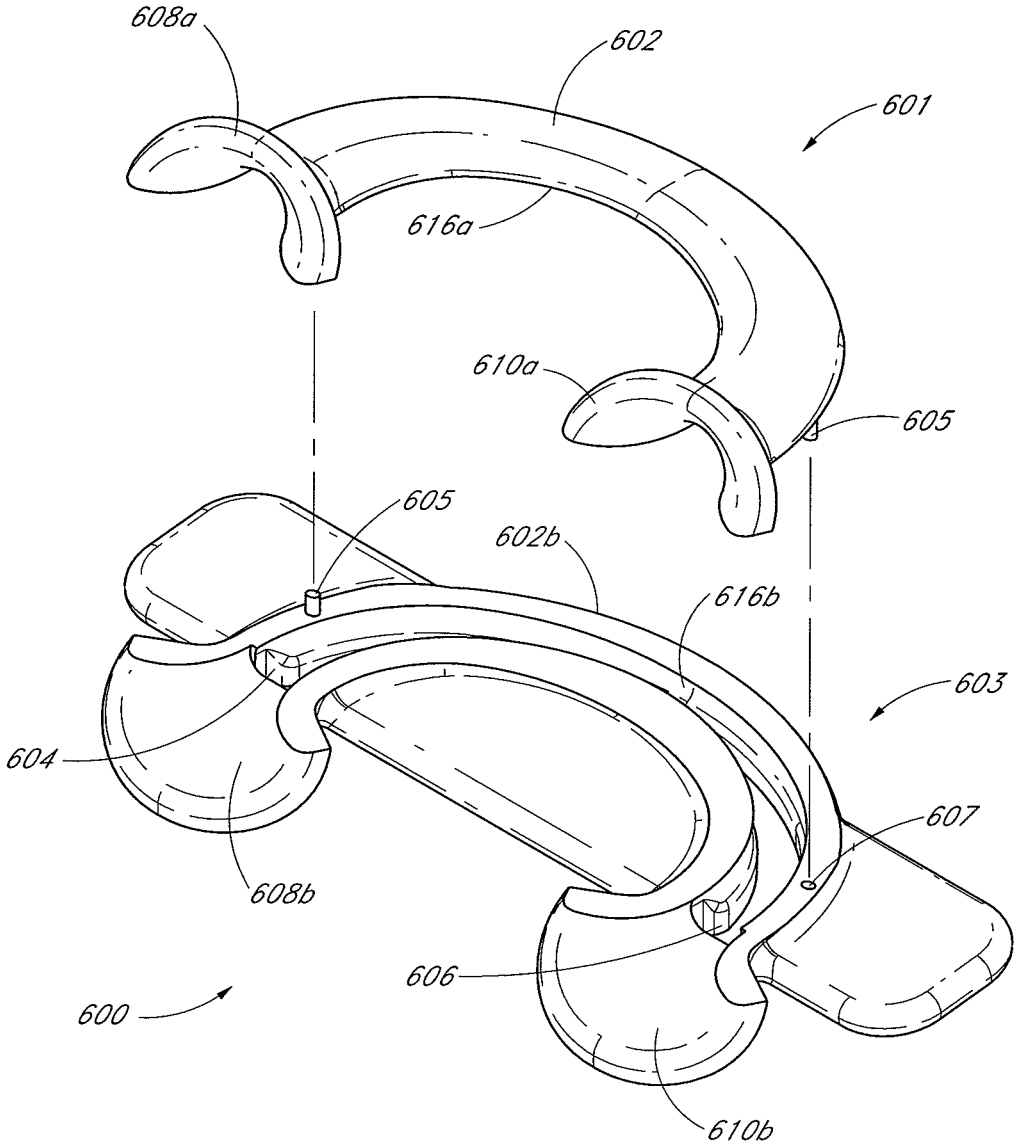
FIG. 6 is an exploded perspective view of another embodiment of a lace guide.

FIG. 6 shows an exploded perspective view of another embodiment of a double-end-piece lace guide 600, which in some ways can be similar to, or the same as, the lace guide 300, or any other lace guide disclosed herein. The lace guide 600 can be a two part construction formed from an upper portion 601 and a lower portion 603. The upper portion 601 can include an upper lace channel portion 602*a*, and upper portions of the first and second end pieces 608*a*, 610*a*. The lower portion 603 can include a lower portion of the lace channel 602*b* and lower portions of the first and second end pieces 608*b*, 610*b*. In some embodiments, the end pieces can be formed as complete integral pieces with the lower portion 603 such that the upper portion 601 includes only the top of the lace channel 602*a*.

The upper portion 601 can be attached to the lower portion 603 by an adhesive, sonic welding, a snap fit connection, or any other suitable type of connection or fastener. In some embodiments, the upper portion 601 and the lower portion 603 can include tabs 605 and corresponding holes 607 to facilitate the alignment and attachment of the upper portion 601 and the lower portion 603.

A main channel 616 can be configured to receive a lace that passes through the lace guide 600. An upper portion of the main channel 616*a* (hidden from view in FIG. 6) can be formed in the bottom surface of the upper portion 601, and a lower portion of the main channel 616*b* can be formed in the top surface of the lower portion 603. Because the upper and lower portions 601, 603 can be molded separately, the main channel 616 can be made without having an open bottom. When the lace guide 600 is assembled, the main channel 616 can be fully enclosed except for the first and second openings 604, 606. This can reduce the occurrence of the lace becoming wedged in the open channel, and the ingress of debris into the channel.

Referring again to FIG. 5, other two part constructions are possible. For example a lace guide can be formed has an open bottom lace channel similar to that shown in the lace guide 300, and a second piece can attach to the lace guide to fill the open channel 318, thereby forming a main channel 316 that is enclosed except for the first and second openings 304, 306.

Figure 7:
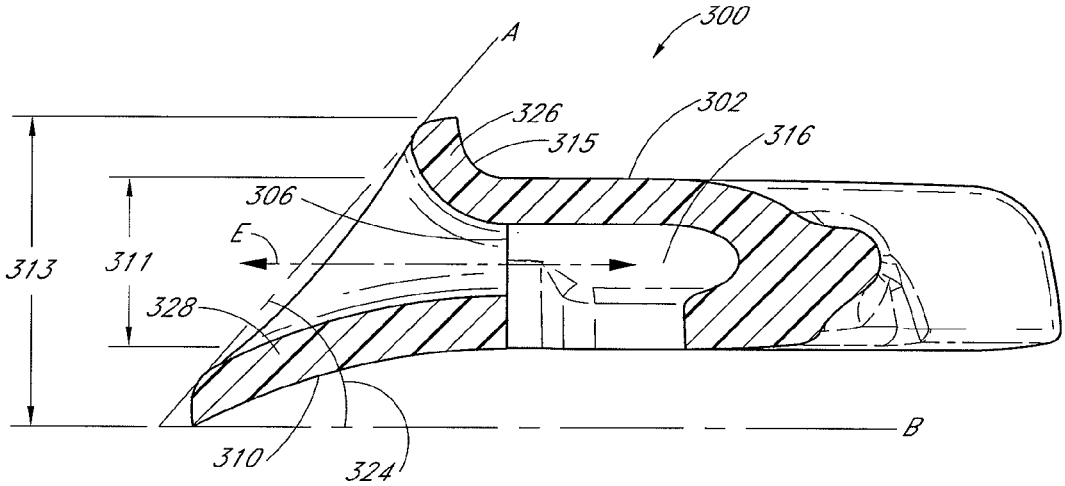
FIG. 7 is a cross-sectional view of the lace guide of FIG. 3.

FIG. 7 is a cross-sectional view of the lace guide 300 taken at a midpoint through the opening 306. The channel 302 can define an axis E which passes through the center of the opening 306 and extends in the direction of a tangent line to the curvature of the lace channel 302 at the opening 306. In some embodiments, the end piece 310 can include a flange extending generally radially (with respect to the axis E extending out of the lace channel 302 via the opening 306) away from the main channel 316. The flange can have a diameter 311 that is larger than an outer diameter 313 of the lace channel 302, thereby forming a ridge or step 315 that extends around the flange. The flange can have an upper flange portion 326 and a lower flange portion 328. As shown, the lower flange portion 328 can extend axially (with respect to the axis E extending out of the lace channel 302 via the opening 306) out away from the lace channel 302 further than does the upper flange portion 326. In some embodiments, a line A drawn from the outer end of the lower flange portion 328 to the outer end of the upper flange portion 326 can be offset from a line B drawn parallel to the lace channel 302 (or parallel to the main channel 316 therein) by an angle 324. The angle 324 can be at least about 5° and/or no more than about 85°, at least about 10° and/or no more than about 80°, at least about 15° and/or no more than about 75°, at least about 30° and/or no more than about 60°, or about 45°, although angles outside of these ranges can also be used.

The upper flange portion 326 can be more curved than the lower flange portion 328. In some embodiments, the upper flange portion 326 can have a radius of curvature of at least about 1.0 millimeter because the lace will generally not ride against this surface and/or of no more than about 3.0 millimeters, or of about 2.0 millimeters, although curvatures outside of these ranges can be used. In some embodiments, the lower flange portion 328 can have a radius of curvature of at least about 4.0 millimeters and/or no of more than about 15.0 millimeters, or of about 10.0 millimeters, although curvatures outside of these ranges can be used. In some embodiments, the curvature of the generally bell-shaped end piece 310 can vary gradually from the least curved portion 328 to the most curved portion 326. In some embodiments, the end piece 310 is not rotationally symmetrical about the axis formed by the opening 306. In some embodiments, the end piece 310 is not symmetrical across a horizontal plane, but is symmetrical across a vertical plane.

The surface of the bell-shaped end piece 310 can provide a sliding surface on which the lace can slide as it moves in and out of the opening 306. In some embodiments, the lace enters the opening 306 from a somewhat sideways direction such that the sliding surface is a portion of the end piece 310 that is between the least curved portion 328 and the most curved portion 326 when the lace is tightened. In some embodiments, the sliding surface can be closer to the least curved lower portion 328 than to the most curved upper portion 326 of the end piece 310. The sliding surface can have a radius of curvature of at least about 2.0 millimeters and/or no of more than about 15.0 millimeters, or of at least about 4.0 millimeters and/or no of more than about 8.0 millimeters, or of about 5.0 millimeters, although curvatures outside of these ranges can be used.

Figure 8:
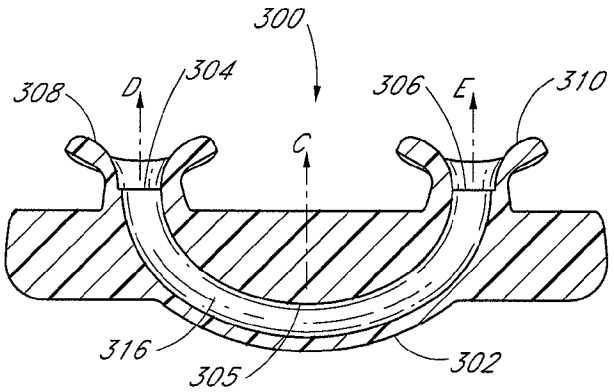
FIG. 8 is another cross-sectional view of the lace guide.

FIG. 8 is a bottom-up cross-sectional view of the lace guide 300 taken through a horizontal plane through a midpoint of the main channel 316. The curvature of the flanges of the end pieces 308, 310 in the plane shown in FIG. 8 can have a radius of curvature of at least about 3.0 millimeters and/or no of more than about 8.0 millimeters, or of about 4.0 millimeters, although curvatures outside these ranges can also be used. In some embodiments, the lace channel 302 can be generally U-shaped. The first opening 304 can face in a direction along axis D, where the axis D is a line passing through the center of the first opening 304 and extending in the direction of a tangent line to the curvature of the main channel 316 at the first opening, similar to the axis E described above. Thus, the lace 330 is directed out of the first opening 304 generally in the direction of the axis D, but the lace path of the lace 330 leaving the first opening 304 can vary from the direction of the axis D depending on the position toward which the lace 330 extends (e.g., toward a next lace guide) and/or depending on the curvature of the lace 330 through the main channel 316. The second opening 306 can face along an axis E, where axis E is similar to the axis D, a line passing through the center of the second opening 306 and extending in the direction of a tangent line to the curvature of the main channel 316 at the second opening 306, as described above. Thus, the lace 330 can be directed out of the second opening 306 generally in the direction of the axis E, but the lace path of the lace 330 leaving the second opening 306 can vary from the direction of the axis E depending on the position toward which the lace 330 extends (e.g., toward a next lace guide) and/or depending on the curvature of the lace 330 through the main channel 316. In the illustrated embodiment, the first opening 304 and the second opening 306 face in substantially the same direction such that the axis D and the axis E are substantially parallel to each other and/or to a central axis C of the lace guide 300.

As can be seen in FIG. 2, for example, in some cases the lace can enter or exit the lace guide at an angle that is offset from the central axis C of the lace guide. Accordingly, in some embodiments, one or both of the openings 304, 306 can face in a direction that is offset from the central axis C of the lace guide 300 such that the lace 330 is directed out of one or both of the openings 304, 306 generally along the corresponding axes D, E at an angle with respect to the central axis C. In some embodiments, an angle formed between the axis D of the first opening 304 and the axis E of the second opening 306 can be no more than about 45°, or no more than about 30°, or no more than about 15°, or of no more than about 5°. As shown in the illustrated embodiment, in some cases, the openings 304, 306 can face in substantially the same direction. The lace guide 300 can be symmetrical such that each axes D and E are offset from the central axis C by about the same angle. The lace guide 300 can also be asymmetrical, such that the axis D of the first opening 304 is offset from the central axis C by a different angle than the axis E of the second opening 306. For example, the openings 304, 306 can be angled differently depending on their location on the article, such as near the ankle opening of a shoe. One or both of the axes D and E can be offset from the central axis C by an angle of no more than about 30°, or of no more than about 15°, or of no more than about 5°, or close to or equal to 0°, although angles outside of these ranges can also be used.

Figure 9:
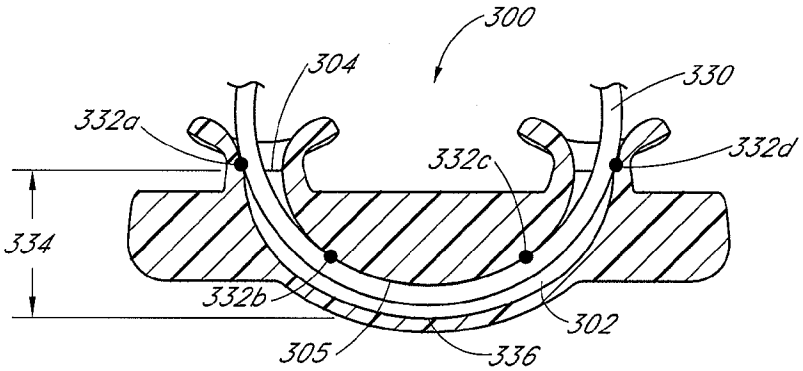
FIG. 9 is a cross-sectional view of another embodiment of a lace guide and a lace used therewith.

FIG. 9 is a cross-sectional view of the lace guide 300 similar to that of FIG. 8, but showing a lace 330 fed through the lace channel. The lace guide 300 can be formed in various sizes. In the embodiment illustrated in FIG. 9, the lace guide 300 is a 15 millimeter lace guide in which the center of the first opening 304 and the center of the second opening 306 are about 15 millimeters apart.

Because at least a portion of the lace channel 302 is disposed within the upper of the shoe, the depth 334 of the lace channel 302 can be greater than on a conventional, external lace guide. A deep external lace guide can appear bulky and cumbersome. Thus, generally, external lace guides have a relatively shallow depth that forces the lace to curve sharper than its natural curvature would allow. This can cause the lace to rub against the inside surface of the lace channel 302 with more force and/or at more locations than would be the case if a deeper lace guide were used that conformed to the natural curvature of the lace. In some embodiments, when the lace 330 is tightened past the threshold level of tension, the lace can be pulled against the front wall 305 of the main channel 316 such that the lace 330 contact the substantially the full length of the front wall 305 through the lace channel 302. In some embodiments, the lace 330 can have a tension that is above the threshold level when the lacing system is fully tightened during use, but the tension of the lace 330 can be below the threshold level during the tightening and loosening process, which is when relative large lengths of the lace 330 slide through the lace channel 302. Thus, in some embodiments, as the lace 330 slides through the lace channel 302 during the tightening and loosening process, the depth 334 of the lace channel 302 can allow the lace 330 to rub against the inside of the lace channel 302 with less force and/or at fewer locations than in a conventional, shallow lace guide.

The threshold level of tension at which the lace 330 abuts against the front wall 305 of the lace channel 302 can depend on the thickness and materials used for the lace 330. For example, a more rigid lace can require more tension to bend than a relatively soft lace. The threshold level of curvature can also depend on the size and shape of the pathway through the lace channel 302. For example, more tension can be required to bend the lace to follow a path having a small radius of curvature. In one example embodiment, for a lace guide having a radius of curvature of 10 mm, and for a lace made of stranded stainless steel of 7×7 construction and having a lace diameter of 1 mm, a tension of about 0.5 to 1.0 pound on each lace end or more would cause the lace to abut against substantially the full length of the inside wall of the lace channel.

In some embodiments, the threshold tension can be high enough and/or the desired tension can be low enough so that the lacing system can be tightened to a usable level without causing the lace 330 to abut against the length of the front wall 305 of the lace channel 302. In some embodiments, when the lace 330 is tight, the lace 330 can still side in the lace channel 302, for example, when the user shifts position in a shoe. As the lace 330 slides through the lace channel 302, the depth 334 of the lace channel 302 can allow the lace 330 to rub against the inside of the lace channel 302 with less force and/or at fewer locations than in a conventional, shallow lace guide. This reduced friction can provide a lacing system in which less force is necessary to move the lace through the lace guides, thereby allowing the tension to be more evenly distributed between the lace guides. Fewer contact points and less friction between the lace guides 300 and the lace 330 can result in less wear on the components. Also, less friction can allow for the tension in the lacing system to be more evenly distributed during the tightening process and during use of the article. When the article (e.g., shoe) flexes during use, less friction in the lacing system can facilitate movement of the lace 330 to redistribute the flex according to the contours of the article (e.g., shoe) during use. While in some conventional lacing systems with conventional eyelets, sharp turns and high friction can be desirable to facilitate tightening and tying of the laces at different progressive points along the closure system, in the lacing system 100, low friction lace guides can be used because the lace can be tightened from a single point or from two or more designated points.

In conventional, relatively shallow, lace guides the lace generally contacts the inside of the lace channel at five points or more. In the lace guide 300, the lace 330 preferably contacts the lace channel 302 at no more than four points when under tension. The four contact points 332*a-d* are shown as dots in FIG. 9. Notably, the lace 330 does not contact the lace channel at or near the apex 336 thereof, as it would if the depth 334 of the lace channel 302 were reduced. In the illustrated embodiment, two of the contact points 332*a*, 332*d* are at or near the openings 304, 306, and two of the contact points 332*b*, 332*c* are deeper inside the lace channel 302, and can be, for example, about midway between the openings 304, 306 and the apex 336. In the embodiment shown in FIG. 9, at the apex 336, the lace 330 can be positioned close to the front wall 305 of the lace channel 302 that is nearest the openings 302, 306. For simplicity the four contact points 332*a-d* are shown positioned along a single plane at the cross section of FIG. 9. However, in some embodiments, the lace 330 can enter the lace channel 302 at an angle such that the points of contact 332*a-d* do not lie on a plane level with the lace channel 302. For example, in some embodiments, the contact points 332*a* and 332*d* an be lower in the main channel 316 (e.g., on or near a bottom surface of the main channel 316) than the contact points 332*b* and 332*c* (which can be on or near a top surface of the main channel 316).

Figure 10:
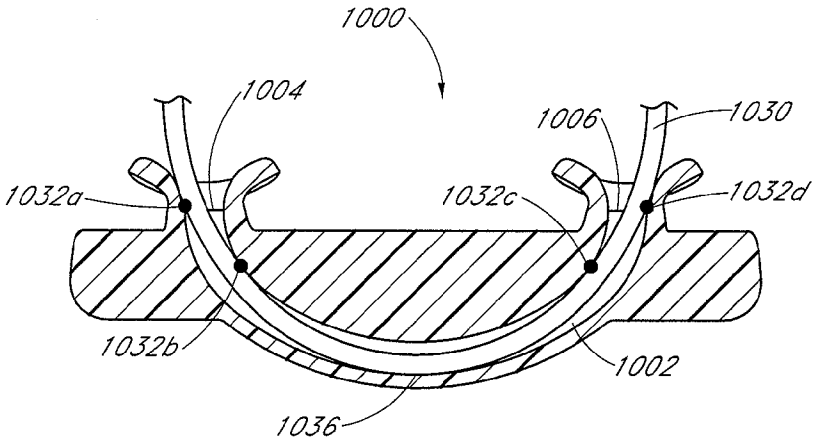
FIG. 10 is a cross-sectional view of another embodiment of a lace guide and a lace used therewith.

FIG. 10 is a cross-sectional view of a 20 millimeter lace guide 1000 in which the openings 1004 and 1006 are spaced apart by about 20 millimeters. A lace 1030 passes through the lace channel 1002 and contacts the lace channel 1002 at four contact points 1032*a-d*. In the embodiment shown in FIG. 10, the lace 1030 can be positioned near the back wall of the lace channel 1002 when at the apex 1036.

Figure 11:
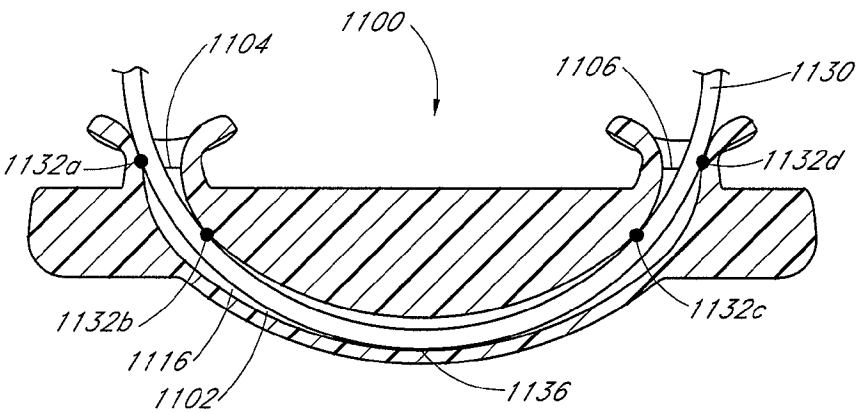
FIG. 11 is a cross-sectional view of another embodiment of a lace guide and a lace used therewith.

FIG. 11 is a cross-sectional view of a 25 millimeter lace guide 1100 in which the openings 1104 and 1106 are spaced apart by about 25 millimeters. A lace 1130 passes through the lace channel 1102 and contacts the lace channel 1102 at four contact points 1132*a-d*. In the embodiment shown in FIG. 11, the lace 1130 can be spaced away from both the front and back walls of the lace channel 1102 when at the apex 1136.

Many variations are possible. For example, lace guides of other sizes can be made (e.g., 30 millimeter lace guides, or lace guides of sizes between any of those discussed herein). The curvature of the lace channels 302, 1002, 1102 can be modified depending on the properties (e.g., materials and thickness) of the lace to be used. For example, a lace with a higher modulus of elasticity is more difficult to bend and stretch. The friction in the lacing system can be increased by using a lace with a higher modulus of elasticity or by turning the lace across tighter corners with a lower radius of curvature. The friction in the lacing system can be decreased by using a lace with a lower modulus of elasticity or by increasing the radius of curvature of the corners. Thus, to maintain a low friction, if a lace is changed to have a higher modulus of elasticity, the radius of curvature in the lace guides can be increased to compensate.

In some embodiments, changing the properties of the lace or changing the curvature of the lace channels 301, 1002, 1102 can adjust the positions of the four contact points without adding a fifth contact point. As can be seen in FIG. 11, for example, the curvature of the main channel 1116 can be tighter (having a smaller radius of curvature) near the openings 1104, 1106 than near the apex 1136. In some embodiments, the curvature of the main channel 1116 can be substantially uniform or can be tighter near the apex 1136 than near the openings 1104, 1106. While in illustrated embodiment, the main channel 1116 has a substantially uniform width, in some embodiments the width of the main channel 1116 can vary. For example, the main channel 1116 can be wider near the apex than near the openings 1104, 1106, or vise versa.

FIGS. 12A-F show steps of an example embodiment of a method for attaching the lace guide 300 to a shoe 340. At FIG. 12A, the lace guide 300 can be stitched to a reinforcement material 342 or tough stay. The stitching 344 can extend across the stitch flange 312. In some embodiments, the stitching 344 can pass over the lace channel 302 without any of the stitches passing through the lace channel 302. At FIG. 12B, the reinforcement material 342 can be attached to a liner 346 or inner material of the shoe 340 or other article using an adhesive or stitching or any other suitable attachment manner. Stitch flange 312 may provide additional strength to guide 300 to allow a softer material in the guide 300 while preventing the guide 300 from ripping from the article when placed under operational forced. The stitch flange 312 can simplify the stitching process by allowing a single linear stitch line 344 to be used to secure the guide 300, rather than stitching along the curved path formed by the lace channel 302.

Figure 12A:
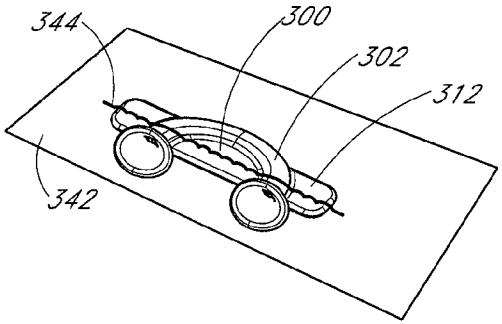
FIGS. 12A-F show steps for attaching the lace guide to a shoe, according to some embodiments.
Figure 12B:
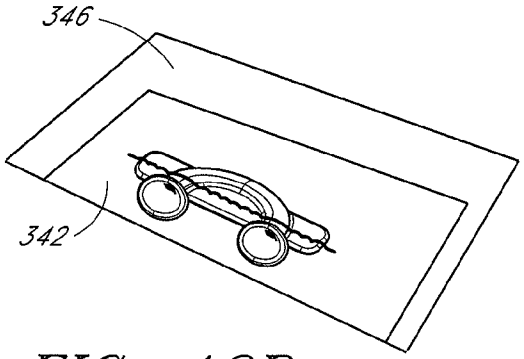
Figure 12C:
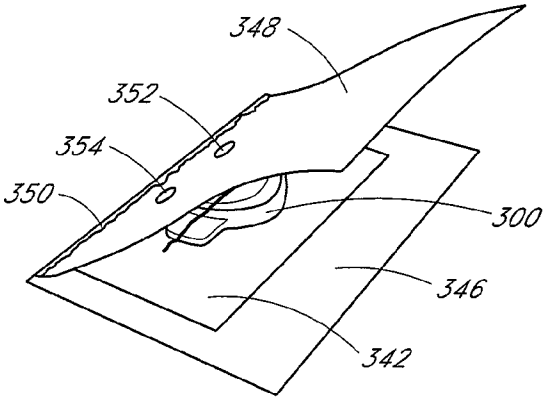

At FIG. 12C, an upper layer 348 is applied over the liner 346, reinforcement material 342, and lace guide 300. The upper layer can be stitched along one edge, and the stitching 350 can capture the upper layer 348, the reinforcement material 342, and the liner 346. As can be seen in FIG. 12C, the upper layer 348 can include two holes 352, 354. The first hole 352 can align with the first end piece 308, and the second hole 354 can align with the second end piece 310.

Figure 12D:
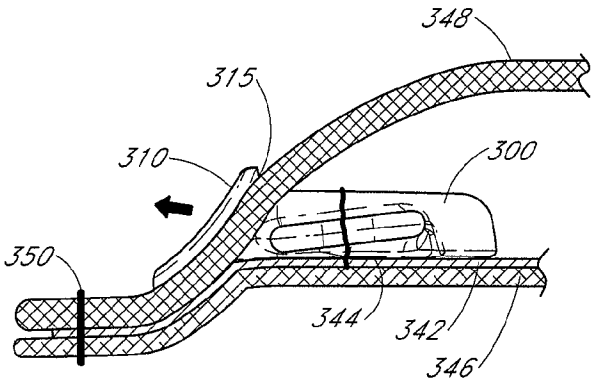

At FIG. 12D, the end pieces 308, 310 are pushed through the corresponding holes 352, 354. In some embodiments, the material of the upper layer 348 can flex to allow the holes 352, 354 to widen when the end pieces are pushed through. In some embodiments, the holes 352, 354 can have a slit that allows the holes 352, 354 to open wide enough for the end pieces 308, 310 to pass through. In some cases, the slits can be stitched closed to prevent the end pieces 308, 310 from passing back through the holes 352, 354 or can be positioned under the external flange. The ridge or step 315 on the flange can prevent the flange from being pulled back through the corresponding hole.

Figure 12E:
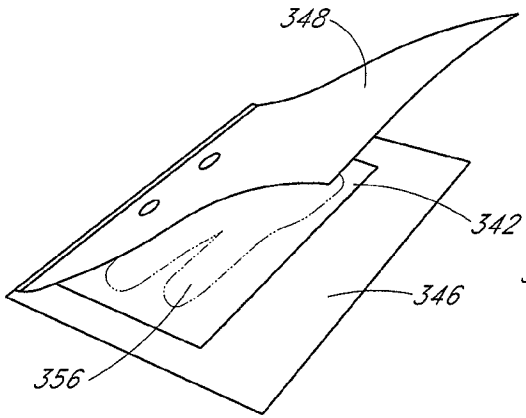
Figure 12F:
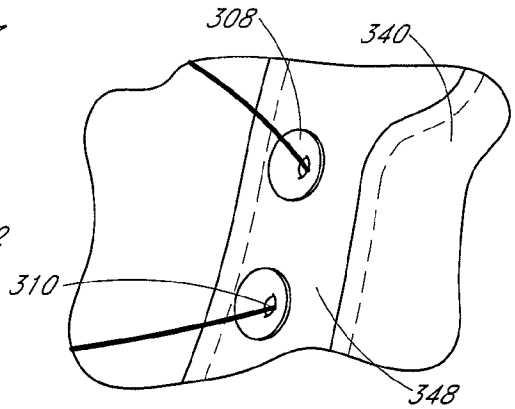

At FIG. 12E, the upper layer 348 can be secured to the lace guide 300, the reinforcement material 342, and/or to the liner 346. In some embodiments, an adhesive 356 can be applied under the upper layer 348 and the upper layer 348 can pressed down onto the lower layers. Stitching (not shown) or any other attachment method can be applied to secure the upper layer 348 to the lower layers. FIG. 12F shows the shoe 340 with the upper layer 348 secured over the lace channel 302 portion of the lace guide with the end pieces 308, 310 exposed through the holes 352, 354 in the upper layer.

Many variations are possible. For example, the reinforcement material 342 and/or the liner 346 can be omitted. In some embodiments, the lace guide 300 can be secured directly to a structure of the shoe 340. In some embodiments, the lace guide 300 can be positioned in a recess (not shown) in the shoe 340 that is configured to receive the lace guide 300 such that the lace guide is substantially flush with the surrounding surfaces, thereby reducing or eliminating the bulge which can be produced by the cover portion of the lace guide 300.

Figure 13:
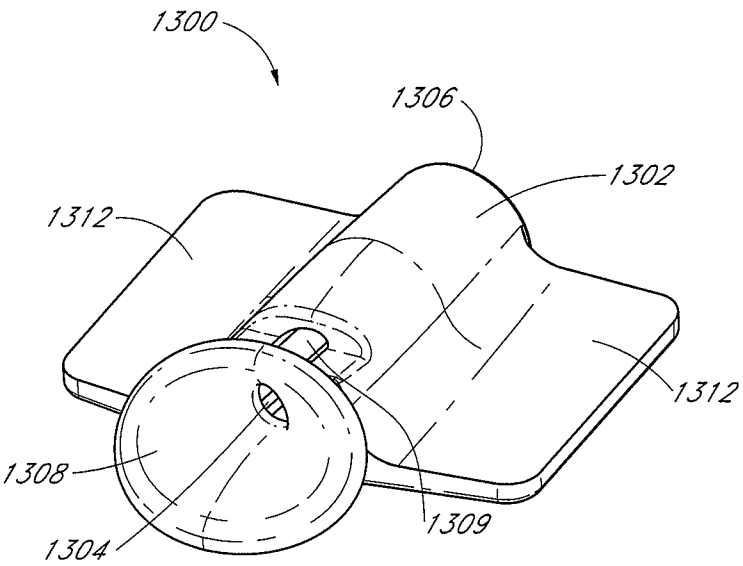
FIG. 13 is a perspective view of another embodiment of a lace guide.

FIG. 13 is a front-top perspective view of a single-end-piece lace guide 1300. Much of the disclosure that relates to the double-end-piece lace guides (e.g., 300) also applies to the lace guide 1300. The single-end-piece lace guide 1300 can have a lace channel 1302 with a first opening 1304 and a second opening 1306 at the opposite end thereof. A supplemental lace channel (not shown), e.g., formed by a tubing, can be attached to the second opening 1306 in some embodiments, and in some cases can be inserted into the lace channel 1302. An end piece 1308 can be positioned at or near the opening 1304. The end piece 1308 can be similar to, or the same as, the end piece 308 described above. A stitch flange 1312 can extend from either side of the lace channel 1302. In some embodiments, a hole 1309 can be positioned on the top surface of the lace channel 302 at a location that is near the top flange portion 1326 of the end piece 1308. This hole 1309 can allow a tubing which is inserted to be viewable to assure that it is all the way seated into the guide.

Figure 14:
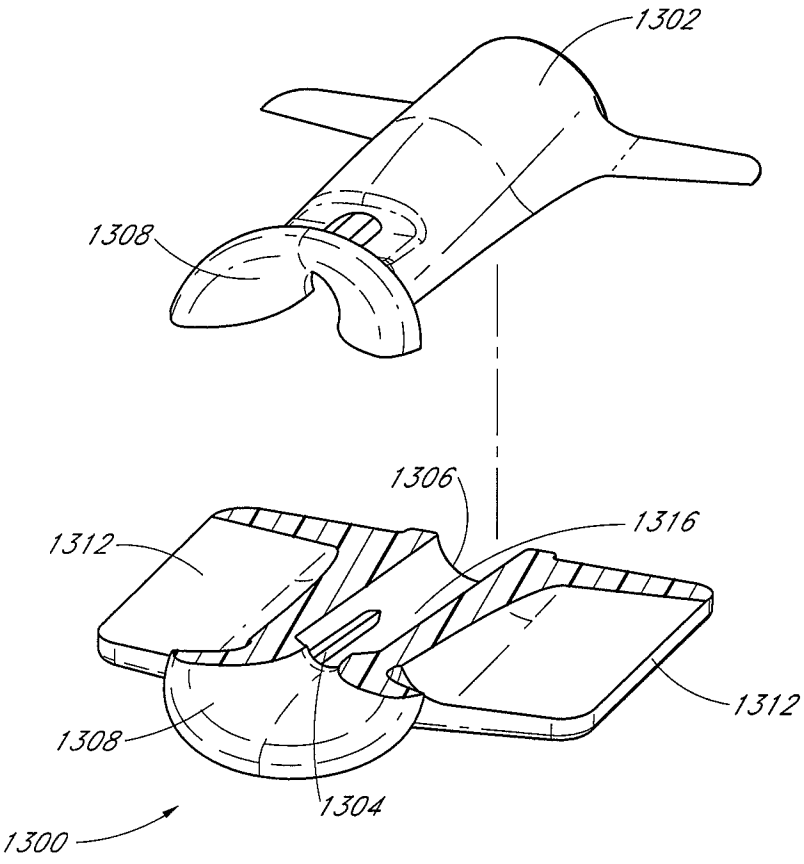
FIG. 14 is a split view of the lace guide shown in FIG. 13.
Figure 15:
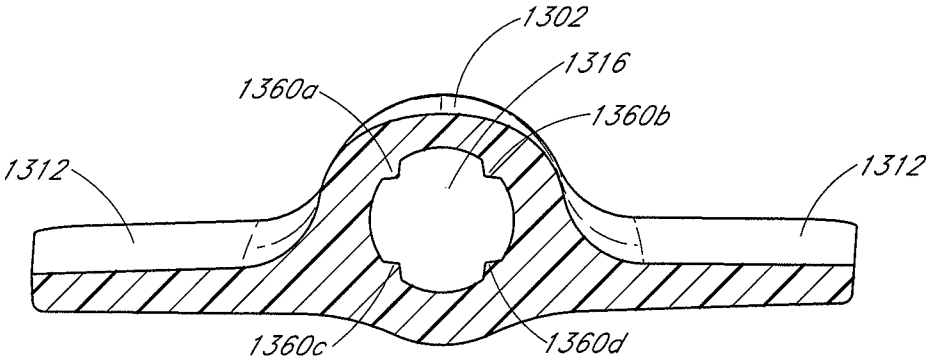
FIG. 15 is a cross-sectional view of the lace guide shown in FIG. 13.
Figure 16:
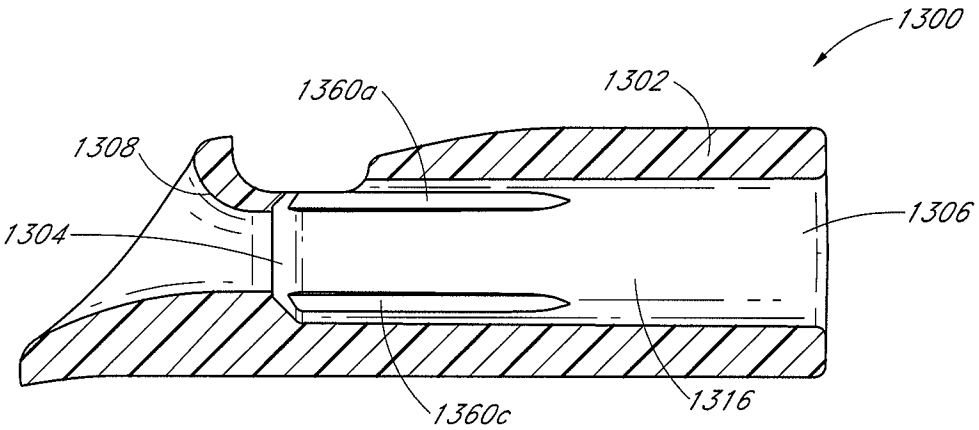
FIG. 16 is another cross-sectional view of the lace guide shown in FIG. 13.

FIG. 14 is a split view of the lace guide 1300 slip along a horizontal plane that intersects the main channel 1316 at its midpoint. In some embodiments, the main channel 1316 does not have an open bottom because an insertion piece can be removed, for example, via the hole 1306 after the molding process. In some embodiments, one or more ridges 1360 can extend from near the opening 1304 toward the other opening 1306, and can end at about the midpoint between the first and second openings 1304, 1306. These ridges 1360 may be present to more easily allow a press fit to be achieved to the inserted tubing to reliably hold the tubing in place. In some embodiments, the main channel 1316 can include four ridges 1360*a-d*, as can be seen, for example, in the cross-sectional views of FIGS. 15 and 16.

While discussed in terms of certain embodiments, it should be appreciated that the disclosure is not so limited. The embodiments are explained herein by way of example, and there are numerous modifications, variations and other embodiments that may be employed that would still be within the scope of the present invention. Components can be added, removed, and/or rearranged both within certain embodiments and between embodiments. Additionally, processing steps may be added, removed, or reordered. A wide variety of designs and approaches are possible. Where numerical values and/or ranges are disclosed, other numerical values can also be used. For example, some embodiments can use numerical values that are outside the disclosed ranges.

For purposes of this disclosure, certain aspects, advantages, and novel features of embodiments of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

What is claimed is:

1. A lace guide comprising:

a lace channel configured to slidably receive a lace;

a first opening configured to receive the lace at a first end of the lace channel, wherein the lace channel defines an axis that extends out of the lace channel through the first opening;

a second opening configured to receive the lace at a second end of the lace channel; and a first flange positioned at the first opening, the first flange having a lower portion positioned below the first opening and an upper portion positioned above the first opening, wherein the lower portion extends axially further away from the lace channel than does the upper portion such that the lower portion forms a sliding surface configured to allow the lace to slide thereon as the lace moves through the lace guide, and wherein the first flange comprises a ridge or step.

2. The lace guide of claim 1, further comprising a second flange positioned at the second opening, the second flange having a lower portion below the second opening and an upper portion above the second opening, wherein the lower portion extends axially further away from the lace channel than does the upper portion such that the lower portion forms a sliding surface configured to allow the lace to slide thereon as the lace moves through the lace guide.

3. The lace guide of claim 1, wherein the first flange is shaped such that a line drawn from the end of the lower portion of the first flange to the end of the upper portion of the first flange is angled with respect to the lace channel by an angle between about 5° and about 85°.

4. The lace guide of claim 1, wherein the first flange is shaped such that a line drawn from the end of the lower portion of the first flange to the end of the upper portion of the first flange is angled with respect to the lace channel by an angle between about 30° and about 60°.

5. The lace guide of claim 1, wherein the first flange is shaped such that a line drawn from the end of the lower portion of the first flange to the end of the upper portion of the first flange is angled with respect to the lace channel by an angle of about 45°.

6. The lace guide of claim 1, wherein the lower portion of the first flange comprises a curved surface providing at least a portion of the sliding surface configured to engage the lace, the curved surface having a radius of curvature between about 2 millimeters and about 10 millimeters.

7. The lace guide of claim 1, wherein the lower portion of the first flange comprises a curved surface providing at least a portion of the sliding surface configured to engage the lace, the curved surface having a radius of curvature between about 4 millimeters and about 8 millimeters.

8. The lace guide of claim 1, wherein the lower portion of the first flange comprises a curved surface providing at least a portion of the sliding surface configured to engage the lace, the curved surface having a radius of curvature of about 5 millimeters.

9. The lace guide of claim 1, wherein the lace channel comprises a main channel configured to receive the lace, and an open channel that connects the main channel to outside the lace guide, wherein at least a portion of the main channel is wider than the open channel thereby forming a front undercut along a front side of the main channel and a back undercut along a back side of the main channel.

10. The lace guide of claim 1, further comprising a lace having an outer surface, and wherein at least the sliding surface on the first flange is formed from a material that is softer than the outer surface of the lace.

11. The lace guide of claim 1, wherein the lace channel is at least about 10 mm in length.

12. The lace guide of claim 1, wherein the lace channel is substantially U-shaped such that the lace channel has a first direction at the first opening and a second direction at the second opening, and wherein an angle formed between the first direction and the second direction is less than about 45°.

13. The lace guide of claim 1, wherein the lace channel is substantially U-shaped such that the lace channel has a first direction at the first opening and a second direction at the second opening, and wherein the first direction is substantially parallel to the second direction.

14. The lace guide of claim 1, wherein the first flange is generally bell shaped.

15. The lace guide of claim 2, wherein the first flange is generally bell shaped and the second flange is generally bell shaped.

16. A method of securing a lace guide to an article having an upper layer, the method comprising:

providing the lace guide of claim 1, wherein the lace guide further comprises a second flange positioned at the second opening;

placing an upper layer of the article over a portion of the lace guide, wherein the upper layer has a first hole and a second hole; and passing the first and second flanges through the corresponding first and second holes in the upper layer such that the first and second flanges are positioned above the upper layer while the lace channel is positioned below the upper layer.

17. The method of claim 16, further comprising:

securing the lace guide to a liner; and securing the upper layer to the liner.

18. An assembly of a lace guide secured to an article having an upper layer, the assembly comprising:

the lace guide of claim 1, wherein the lace guide further comprises a second flange positioned at the second opening; and an upper layer of the article positioned over a portion of the lace guide, wherein the upper layer comprises a first hole and a second hole, and wherein first and second flanges are positioned above the upper layer at the corresponding first and second holes of the upper layer while the lace channel is positioned below the upper layer.

19. The assembly of claim 18, wherein the article further comprises a liner, wherein the lace guide is secured to the liner and the upper layer is secured to the liner.

20. The assembly of claim 18, wherein the lace guide further comprises a stitch flange attached to the lace channel; and wherein stitching secures the stitch flange to the article.

21. The assembly of claim 18, wherein the article comprises a first side and a second side, wherein the lace guide is positioned on the first side of the article, wherein the first side of the article comprises the upper layer positioned over the lace guide, wherein the lace channel has a first direction at the first opening and the lace channel has a second direction at the second opening, and wherein an angle formed between the first direction and the second direction is less than about 45°.

22. The assembly of claim 18, wherein the first flange is generally bell shaped.

23. The assembly of claim 22, wherein the second flange is generally bell shaped.

24. An article that includes a lace and at least one lace guide, the article comprising:

a first portion of the article;

a second portion of the article;

a lace configured to tighten the article by drawing the first portion of the article and the second portion of the article toward each other as tension is applied to the lace;

the lace guide of claim 1 coupled to the first portion of the article;

wherein the lace channel has a first direction at the first opening and a second direction at the second opening, and wherein an angle formed between the first direction and the second direction is less than about 45°, and wherein the lace channel is curved, the lace having a rigidity and the lace channel having a curvature that are configured to provide no more than four points of contact between the lace guide and the lace when the lace is under tension and when the tension on the lace is below a threshold level, and wherein the lace is pulled against the front wall of the lace channel when the tension on the lace is above the threshold.

25. The article of claim 24, wherein a first point of contact is at the first opening, a second point of contact is at the second opening, a third point of contact is located inside the lace channel, and a fourth point of contact is located inside the lace channel.

26. The article of claim 25, wherein the first point of contact and the second point of contact are on a back wall of the lace channel, and wherein the third point of contact and the fourth point of contact are on a front wall of the lace channel.

27. The article of claim 26, wherein the lace does not contact the back wall of the lace channel between the first contact point and the second contact point.

28. The article of claim 24, wherein the lace does not contact a back wall of the lace channel at an apex of the lace channel.

29. A lace guide comprising:

a lace channel configured to slidably receive a lace;

a first opening configured to receive the lace at a first end of the lace channel, wherein the lace channel defines an axis that extends out of the lace channel through the first opening;

a second opening configured to receive the lace at a second end of the lace channel; and a first flange positioned at the first opening, the first flange having a lower portion positioned below the first opening and an upper portion positioned above the first opening, wherein the lower portion extends axially further away from the lace channel than does the upper portion such that the lower portion forms a sliding surface configured to allow the lace to slide thereon as the lace moves through the lace guide;

wherein the lace channel is substantially U-shaped such that the lace channel has a first direction at the first opening and a second direction at the second opening, and wherein an angle formed between the first direction and the second direction is less than about 45°.

30. The lace guide of claim 29, further comprising a second flange positioned at the second opening, the second flange having a lower portion below the second opening and an upper portion above the second opening, wherein the lower portion extends axially further away from the lace channel than does the upper portion such that the lower portion forms a sliding surface configured to allow the lace to slide thereon as the lace moves through the lace guide.

31. The lace guide of claim 29, wherein the first flange is shaped such that a line drawn from the end of the lower portion of the first flange to the end of the upper portion of the first flange is angled with respect to the lace channel by an angle between about 30° and about 60°.

32. The lace guide of claim 29, wherein the lower portion of the first flange comprises a curved surface providing at least a portion of the sliding surface configured to engage the lace, the curved surface having a radius of curvature between about 2 millimeters and about 10 millimeters.

33. The lace guide of claim 29, wherein the first direction is substantially parallel to the second direction.

34. An assembly of a lace guide secured to an article having an upper layer, the assembly comprising:

the lace guide of claim 29, wherein the lace guide further comprises a second flange positioned at the second opening; and an upper layer of the article positioned over a portion of the lace guide, wherein the upper layer comprises a first hole and a second hole, and wherein first and second flanges are positioned above the upper layer at the corresponding first and second holes of the upper layer while the lace channel is positioned below the upper layer.

35. The assembly of claim 34, wherein the article further comprises a liner, wherein the lace guide is secured to the liner and the upper layer is secured to the liner.

36. The assembly of claim 34, wherein the lace guide further comprises a stitch flange attached to the lace channel; and wherein stitching secures the stitch flange to the article.

* * * * *